US010867482B2

(12) United States Patent
Smith

(10) Patent No.: US 10,867,482 B2
(45) Date of Patent: Dec. 15, 2020

(54) GAMING MACHINE WITH SYMBOL REARRANGEMENT

(71) Applicant: Fusion Holdings Limited, Douglas (IM)

(72) Inventor: Grant Michael Smith, Douglas (IM)

(73) Assignee: Fusion Holdings Limited, Douglas (IM)

( * ) Notice: Subject to any disclaimer, the term of this patent is extended or adjusted under 35 U.S.C. 154(b) by 0 days.

(21) Appl. No.: 16/354,616

(22) Filed: Mar. 15, 2019

(65) Prior Publication Data

US 2019/0318585 A1 Oct. 17, 2019

(30) Foreign Application Priority Data

Apr. 11, 2018 (GB) ..... 1805987.3

(51) Int. Cl.
*G07F 17/00* (2006.01)
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
None
See application file for complete search history.

(56) References Cited

U.S. PATENT DOCUMENTS 7,559,837 B1 * 7/2009 Yoseloff ..... G07F 17/3265 273/143 R
8,460,090 B1 * 6/2013 Gilliland ..... G07F 17/3262 463/23
2004/0072613 A1 * 4/2004 Visocnik ..... G07F 17/32 463/25
2005/0014557 A1 * 1/2005 Duhamel ..... G07F 17/3244 463/20
2005/0054441 A1 * 3/2005 Landrum ..... G07F 17/32 463/35
2007/0021189 A1 * 1/2007 Sato ..... G07F 17/32 463/20
2007/0032291 A1 * 2/2007 Marks ..... G07F 17/3262 463/20

(Continued)

FOREIGN PATENT DOCUMENTS

CA 2249791 4/1999

OTHER PUBLICATIONS

Examiner's Report received for Canadian Patent Application No. 3,035,038 , dated Jan. 28, 2020, 4 pages.

*Primary Examiner* — Paul A D'Agostino
(74) *Attorney, Agent, or Firm* — McDonnell Boehnen Hulbert & Berghoff LLP

(57) ABSTRACT

An embodiment may involve selecting a symbol set as an outcome event of a symbol-based game. The symbol-based game may be executed on behalf of a client machine, and each symbol of the symbol set may be associated with a respective symbol position within a respective multi-symbol-position segment. Further, the multi-symbol-position segments may be arranged in a first order so as to form a first arrangement of the symbol set. The embodiment may further involve determining a second order of the multi-symbol-position segments, without altering which symbols are associated with each respective multi-symbol-position segment, so as to form a second arrangement of the symbol set.

11 Claims, 17 Drawing Sheets

(56) References Cited

U.S. PATENT DOCUMENTS

2008/0051180 A1* 2/2008 Okada ..... G07F 17/34 463/20
2008/0188280 A1* 8/2008 Marks ..... G07F 17/3227 463/20
2009/0176568 A1* 7/2009 Reddy ..... G07F 17/3244 463/31
2010/0120484 A1* 5/2010 Caputo ..... A63F 13/005 463/13
2010/0210338 A1* 8/2010 Taylor ..... G07F 17/3293 463/16
2010/0323784 A1* 12/2010 Acres ..... G07F 17/3223 463/25
2011/0118003 A1* 5/2011 Nakamura ..... G07F 17/3244 463/20
2013/0331166 A1* 12/2013 Carranza ..... G07F 17/32 463/20
2014/0087809 A1* 3/2014 Leupp ..... G07F 17/326 463/16
2014/0087815 A1* 3/2014 Caputo ..... G07F 17/34 463/18
2014/0221080 A1* 8/2014 Cohen ..... G07F 17/3225 463/21
2014/0315618 A1* 10/2014 Fujisawa ..... G07F 17/34 463/20
2015/0011302 A1* 1/2015 Mayeroff ..... G07F 17/3262 463/25
2015/0080105 A1* 3/2015 Itagaki ..... G07F 17/326 463/20
2015/0080107 A1* 3/2015 Hirato ..... G07F 17/3213 463/20
2015/0213683 A1* 7/2015 Graham ..... G07F 17/3225 463/25
2015/0221162 A1* 8/2015 Peters ..... A63F 3/0645 463/19
2015/0254925 A1* 9/2015 Wenker ..... G07F 17/329 463/18
2015/0302703 A1* 10/2015 Nelson ..... G07F 17/3213 463/20
2015/0332545 A1* 11/2015 Kitamura ..... G07F 17/3213 463/20
2015/0339880 A1* 11/2015 Zurawski ..... G07F 17/3244 463/20
2016/0110943 A1* 4/2016 Nicely ..... G07F 17/3269 463/20
2016/0203670 A1* 7/2016 Ford ..... G07F 17/3213 463/20
2016/0343202 A1* 11/2016 Fujisawa ..... G07F 17/34
2017/0092045 A1* 3/2017 Kitamura ..... G07F 17/3209
2017/0092050 A1* 3/2017 Kitamura ..... G07F 17/3213
2017/0148251 A1* 5/2017 Carranza ..... G07F 17/3213
2017/0236373 A1* 8/2017 Arnone ..... G07F 17/3209 463/25

* cited by examiner

GAMING MACHINE WITH SYMBOL REARRANGEMENT

CROSS-REFERENCE TO RELATED APPLICATION

This application claims priority to U.K. patent application no. 1805987.3, filed Apr. 11, 2018, which is hereby incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For instance, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine by the computer network. In this instance, the server machine may perform the spins of the game and may send data representing the resulting symbols to the client machine, thereby instructing the client machine to display the symbols.

One advantage of modern slot machines, such as video gaming machines, is the ability to rearrange one or more of the symbols that are displayed on a display without having to re-spin one or more mechanical reels. Within examples, this disclosure provides technical methods and systems that allow for providing a user with two or more results arising from a single wager.

By way of example, a user may place a wager and spin the reels of a video gaming machine. The reels may come to rest, yielding a first arrangement of a symbol set. The first arrangement may be checked for a winning combination using a payout table, and any such winning combinations may be paid out to the user. Further, columns of symbols in the symbol set may then be rearranged, without altering which symbols are associated with the columns themselves, yielding a second arrangement of the symbol set. The second arrangement may then be checked for a winning combination using the payout table, with any winning combinations being paid out to the user. In other examples, instead of or in addition to rearranging columns of symbols in the symbol set, rows of symbols in a symbol set may be rearranged.

Advantageously, these features may assist in making winning results and provide a player with entertainment and additional opportunities to win. In effect, rearranging columns and/or rows of a symbol set may provide a player with two "bites of the cherry", in other words, two chances to win with a single wager.

Viewed from a first aspect, the disclosure provides a computer-implemented method of symbol rearrangement in a symbol-based game. The symbol-based game is executed on behalf of a client machine, and a memory stores a plurality of symbols for the symbol-based game. Accordingly, from the plurality of symbols, a symbol set is selected as an outcome event of the game. The symbol set includes multiple symbols, and each symbol of the symbol set is associated with a respective symbol position within a respective multi-symbol-position segment among a plurality of multi-symbol-position segments. The multi-symbol-position segments of the plurality of multi-symbol-position segments are arranged in a first order so as to form a first arrangement of the symbol set. A second order of the plurality of multi-symbol-position segments is determined without altering which symbols are associated with each respective multi-symbol-position segment, so as to form a second arrangement of the symbol set. The second order is different from the first order. A representation of the second arrangement of the symbol set is transmitted to the client machine, and reception of the representation of the second arrangement of the symbol set causes the client machine to display the second arrangement of the symbol set on a display.

Viewed from a second aspect, the disclosure provides an article of manufacture including a non-transitory computer-readable medium, having stored thereon program instructions that, upon execution by a processor, cause the gaming machine to perform the operations of the first aspect.

Viewed from a third aspect, the disclosure provides a gaming machine configured to perform the operations of the first aspect.

Viewed from a fourth aspect, the disclosure provides a system comprising means for performing the operations of the first aspect.

Viewed from a fifth aspect, the disclosure provides a gaming system that comprises a plurality of client machines each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more client machine processors; and one or more client machine memory devices storing a plurality of client machine instructions. The client machine instructions are executable by the one or more client machine processors to perform the operations of the first aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

The disclosure herein overcomes limitations of past technology by increasing the number and variety of possible outcomes for a randomly selected symbol set in a symbol-based game of luck. Existing arrangements could only address this problem by changing the number of possible symbols from which the symbol set is selected or increasing the number of symbols in the selected symbol set. By rearranging columns and/or rows of symbols in a selected symbol set, the present solution increases the number of possible outcomes resulting from a single selected symbol set without increasing the number of symbols in the selected symbol set.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. Groups of symbols displayed within a symbol-display-portion of a display during an outcome event may be rearranged. The rearranged symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines, systems, and methods for carrying out aspects of outcome events that include displaying symbols. These aspects may be incorporated into games, in particular, wager games. In one aspect, the machines, systems, and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often increase their profits simply by getting more players to play more games. Due to the provided features, players may be drawn in (e.g., from competing casinos that lack games with such a feature) and they may play the game often. The feature can include new data communications between a server machine and a client machine within a server-client based configuration.

II. Example Architecture

Figure 1:
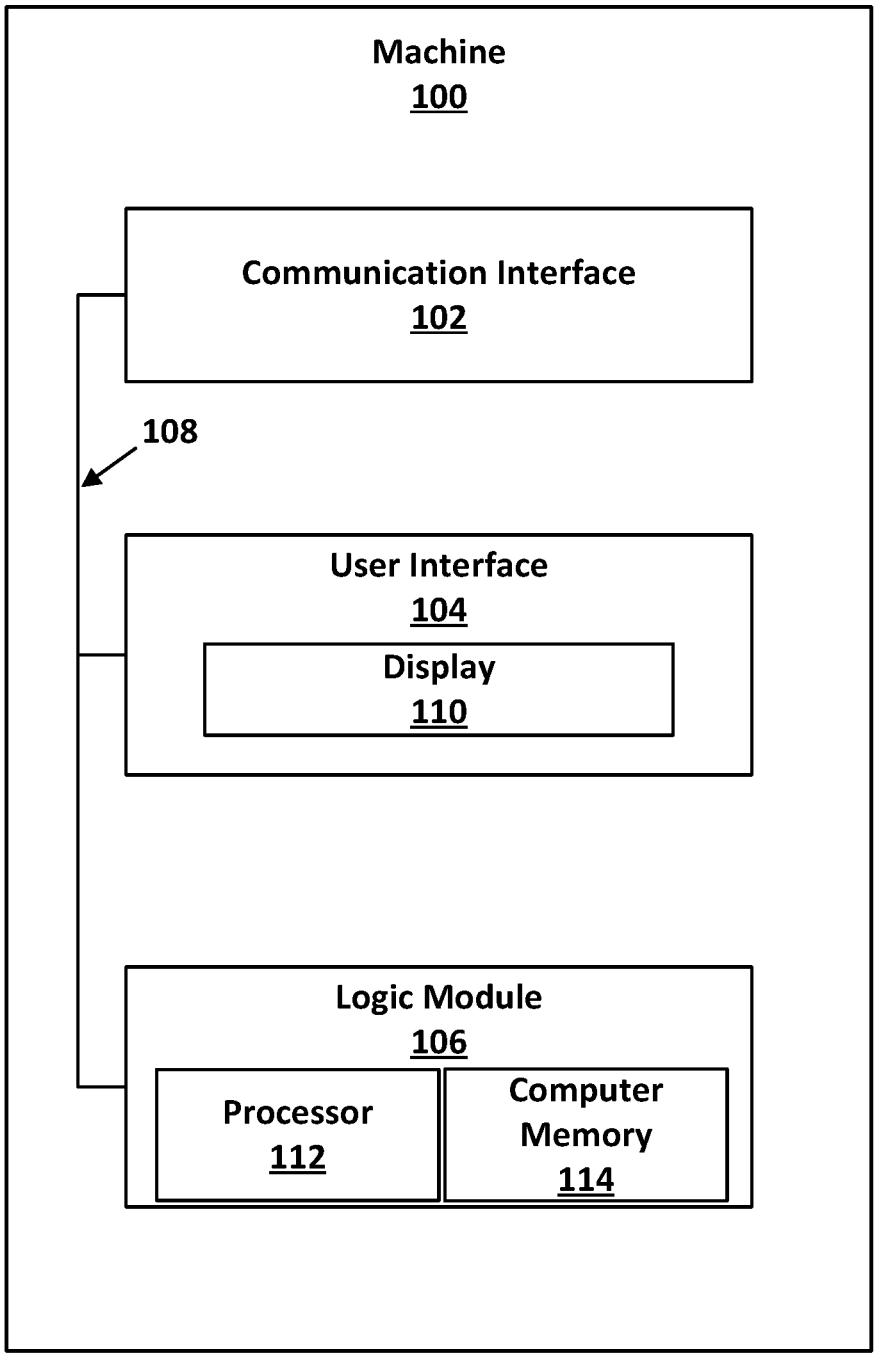
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad, keyboard, mouse, or a touch-sensitive screen. As described in greater detail below, display 110 may be configured to show, among other things, a symbol set in a game or a portion thereof.

The logic module 106 can take the form of a processor 112 and a computer memory 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer processor. Any computer memory discussed in this description or shown in the drawings can be referred to as computer-readable data storage or computer-readable memory.

Computer memory 114 may include volatile or non-volatile storage components and may be integrated in whole or in part with processor 112. Computer memory 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Computer memory 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
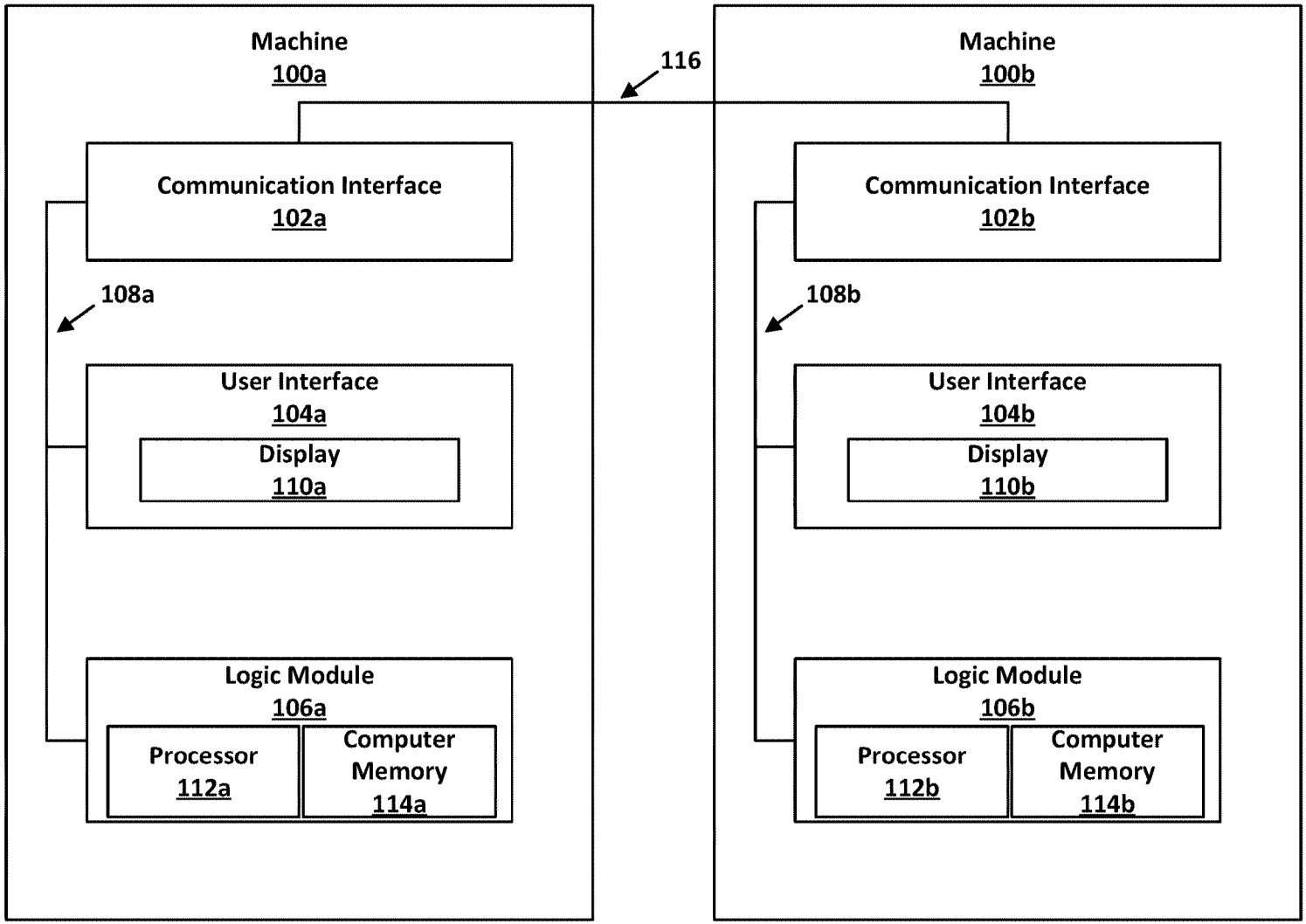
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a communication network 116. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). Server machine 100*a* includes communication interface 102*a*, user interface 104*a* (which incorporates display 110*a*), logic module 106*a* (which incorporates processor 112*a* and computer memory 114*a*), and communication bus 108*a*. Likewise, client machine 100*b* includes communication interface 102*b*, user interface 104*b* (which incorporates display 110*b*), logic module 106*b* (which incorporates processor 112*b* and computer memory 114*b*), and communication bus 108*b*.

The server machine 100*a* is configured to communicate with the client machine 100*b* over communication network 116 (via the communication interfaces 102*a*, 102*b*). Likewise, the client machine 100*b* is configured to communicate with the server machine 100*a* over the communication network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The communication network 116 for the server-client based configuration described above may take a variety of forms. For example, the communication network 116 may be a local area network (LAN) in a casino, such that client machines 100*b* dispersed throughout the casino may communicate with the server machine 100*a* in the casino.

In another example, the communication network 116 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The communication network 116 may include any of a variety of network topologies and network devices, and may employ traditional network-related technologies, including for example the public switched telephone network, cable networks, cellular wireless networks, WiFi, and WiMAX. Further, the communication network 116 may include one or more databases (e.g., a player credit account database), to allow for the storing and retrieving of data related to performing an outcome event by a machine, as well as adjusting account balances associated with client machines.

In some examples, the user interface 104 can include an acceptor of a physical item associated with a monetary value, such as a paper money acceptor, coin acceptor, or a card reader. This acceptor may include a validator configured to identify the physical item, and determine whether the physical item is suitable as payment to the machine.

In some examples, machine 100 may also physically dispense a corresponding payout (e.g., cash), or otherwise facilitate the payout to the player (by adding funds to an electronic account associated with a gaming card). Such an activity may be triggered by a cash out button either on display 110 or elsewhere on machine 100. Additionally or alternatively to determining the payout amount, machine 100 may perform other actions to award the player. For instance, the machine may display an indication of a tangible prize. Other types of awards may be used as well.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within computer memory 114, 114*a*, or 114*b*.

Computer memory 114, 114*a*, and 114*b* can also store data. As an example, a global symbol group for a symbol-based game may include multiple symbols, such as a Wild, an Ace, a King, a Queen, a Jack and a Ten that may be used in connection with the outcome event, such as a wager game. The Ace, King, Queen, Jack, and Ten symbols can represent symbols found on a standard deck of playing cards. The Wild symbol may have special properties that allow it to form winning combinations with other symbols. For instance, the Wild symbol may be substitutable for any other symbol.

However, such a global symbol group may be customized with particular symbols as desired. As some possible examples, the symbols may include images of people, animals, fanciful creatures, cartoon characters, inanimate objects, or other things in addition to or instead of Wild, Ace, King, Queen, Jack, or Ten symbols. Furthermore, Wild symbols may vary in design.

Figure 3:
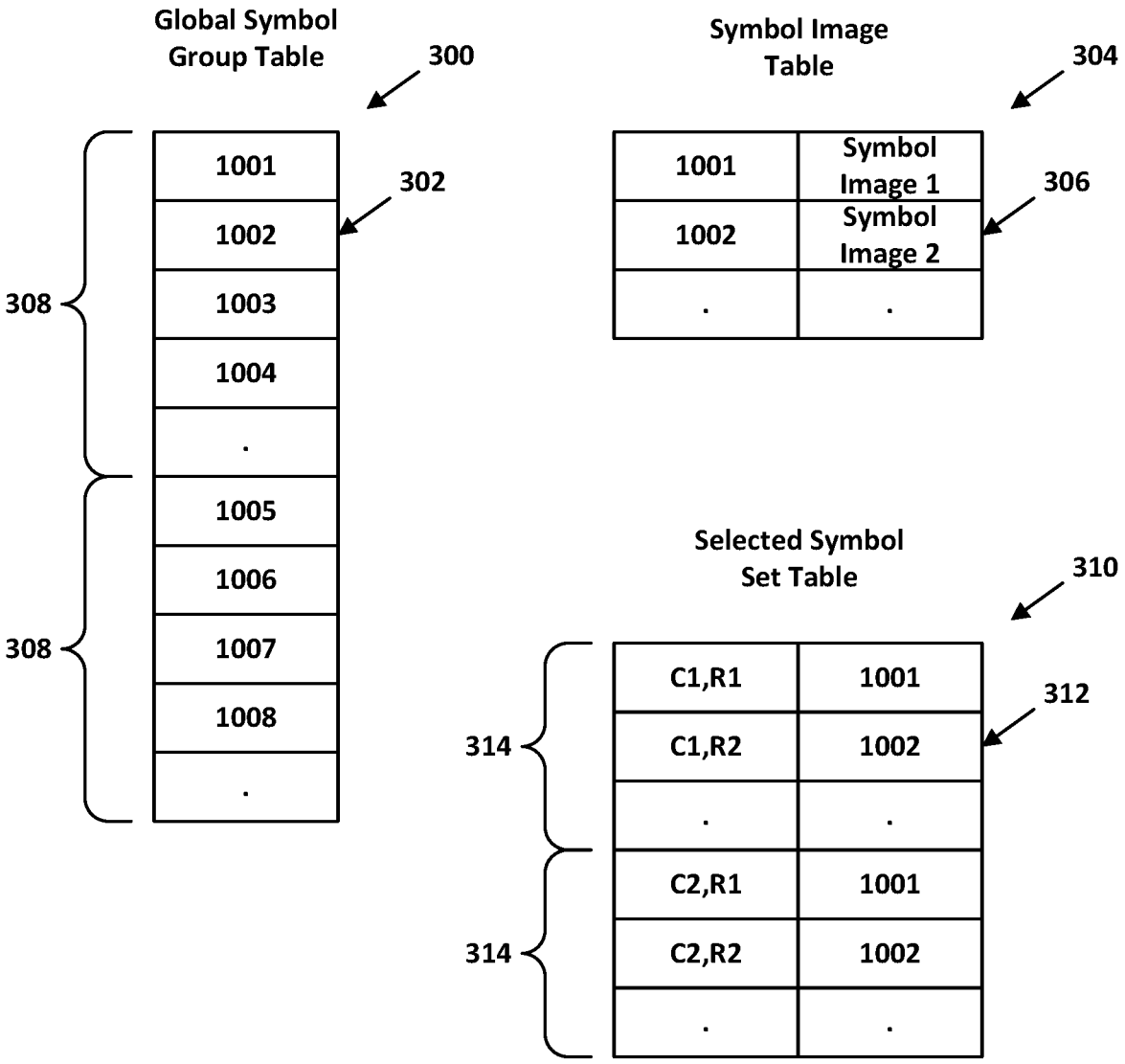
FIG. 3 depicts diagrams of tables that may be used with the processes, machines, and systems herein, in accordance with example embodiments.

In one example, the global symbol group may be represented as a table (or other data structure) stored in computer memory 114. FIG. 3 shows an example global symbol group table 300. The global symbol group table 300 includes multiple records 302, each including an identifier (e.g., 1001, 1002, 1003 1004, etc.) that represents a particular symbol. In one example, the global symbol group, and therefore the global symbol group table 300, may be divided into multiple sub-groups 308. Each sub-group may correspond to a respective column or row of a column-and-row arrangement. Where a column-and-row arrangement is used to simulate reels, each sub-group may correspond to a respective reel. In some instances, a sub-group may represent an ordering of symbols on a particular reel.

The global symbol group table 300 may be used in connection with a symbol image table 304. The symbol image table 304 includes multiple records 306 (shown as distinct rows of symbol image table 304), each including an identifier that represents a particular symbol, and a corresponding displayable image. As such, the symbol image table 304 may be used to map an identifier in the global symbol group table 300 to a displayable image. Such an image may be arranged according to the Joint Photographic Experts Group (JPEG), Graphics Interchange Format (GIF), or Portable Network Graphics (PNG) encodings, for example.

During the course of a game, various symbol sets may be selected for display. Each selected symbol set may be stored in a table such as selected symbol set table 310. Selected symbol set table 310 includes multiple records 312 (shown as distinct rows in selected symbol set table 310), each record including an arrangement position of the symbol, and an identifier that represents the symbol. As such, each symbol in the selected symbol set may correspond with a respective arrangement position in a display arrangement (e.g., both a column number and a row number in a column-and-row arrangement). As an example, C1,R1, shown in the selected symbol set table 310, represents a symbol position at column 1 (e.g., a left-most column of a plurality of columns in a symbol-display-portion of display 110) and row 1 (e.g., a top row of a plurality of rows in a symbol-display-portion of display 110). The column identifiers in selected symbol set table 310 (e.g., C1 and C2) can refer to columns in a symbol matrix or reels of a plurality of reels that can be spun.

In one example, machine 100 may select a symbol set by iterating through each record 312 in the selected symbol set table 310, and selecting a symbol identifier from among the symbol identifiers in the global symbol group table 300. In some examples, the symbol identifiers are numbers and machine 100 uses a random number generator to select such numbers, and therefore to randomly select symbols.

In some examples, machine 100 may select subsets of the symbol set from corresponding sub-groups in the global symbol group. This type of selection may be used when the symbol set represents one or more reels in a reel-type wager game. In this instance, each sub-group can include all the symbols of a given reel, and a selected subset of symbols can include the symbols of the reel that are "in play," namely those included in the selected symbol set.

Figure 4:
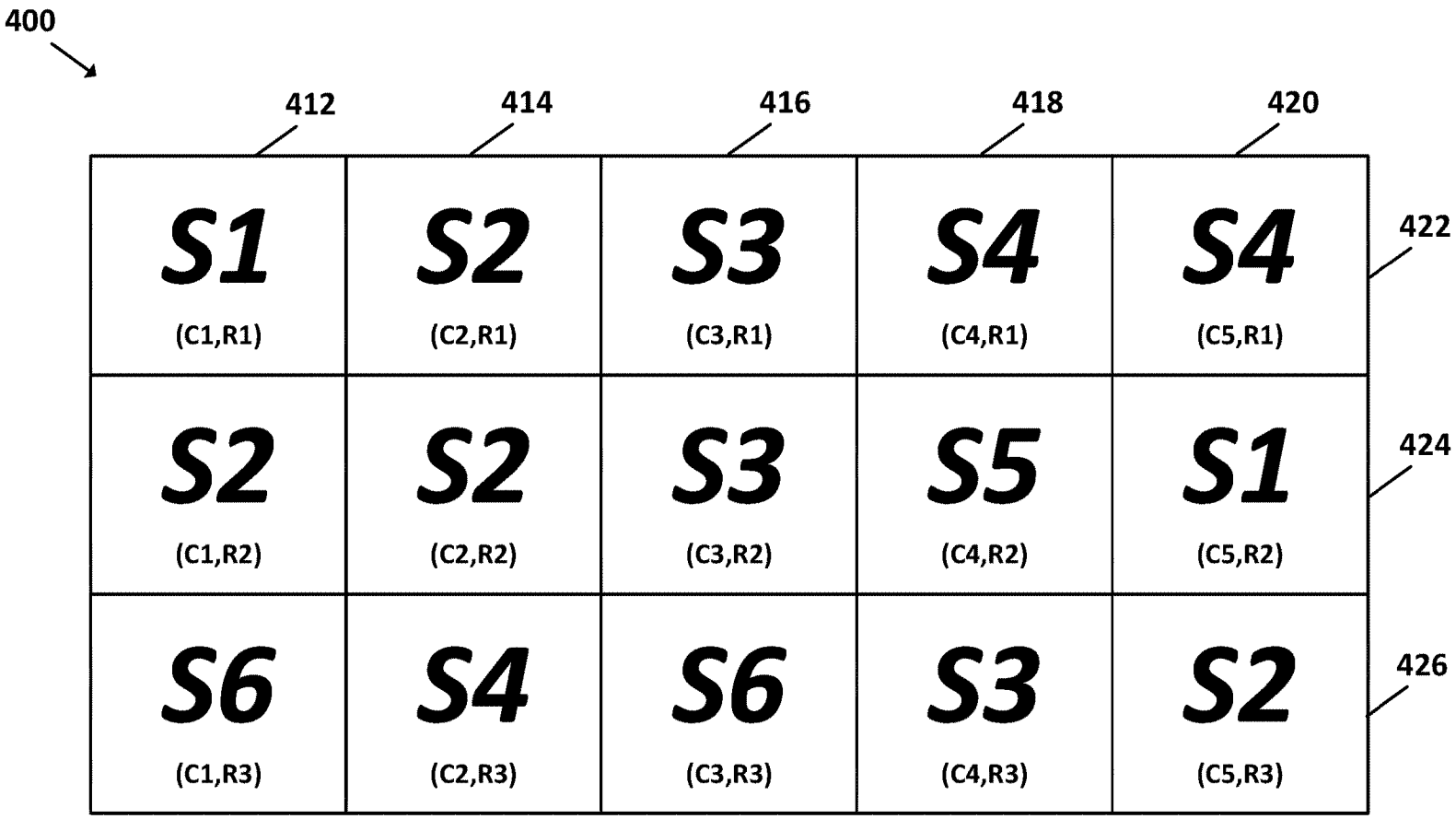
FIG. 4 depicts an example of a selected symbol set in a display, in accordance with example embodiments.

FIG. 4 shows an example of a selected symbol set 400 from the global symbol group for display during a base or bonus outcome event. An example symbol-based game can include a plurality of multi-symbol-position segments and multiple symbol positions within the plurality of multi-symbol-position segments. Each symbol of the selected symbol set 400 can be associated with a respective symbol position within a respective multi-symbol-position segment among the plurality of multi-symbol-position segments.

As an example, the multi-symbol-position segments can include vertical multi-symbol-position segments 412, 414, 416, 418, and 420 (or more simply, vertical MSPSs 412-420). As another example, the multi-symbol-position segments can include horizontal multi-symbol-position segments 422, 424, and 426 (or more simply, horizontal MSPSs 422-426). Each multi-symbol-position segment can include multiple symbol positions. The vertical MSPSs 412-420 are shown in FIG. 4 as having three symbol positions. The horizontal MSPSs 422-426 are shown in FIG. 4 as having five symbol positions. A person skilled in the art will understand that those multi-symbol-position segments can be configured with different numbers of symbol position than shown in FIG. 4.

In some examples, the multi-symbol-position segments can form a grid of symbol positions, such as a grid of symbol positions having a column-and-row arrangement. With this configuration, the vertical MSPSs 412-420 can be columns of the grid of symbol positions and the horizontal MSPSs 422-426 can be rows of the grid of symbol positions. The multiple symbol positions shown in FIG. 4 are identified by column and row designators, in which C1=column 1, C2=column 2, C3=column 3, C4=column 4, C5=column 5, R1=row 1, R2=row 2, and R3=row 3. C1 can be a first MSPS. C2 can be a second MSPS. C3 can be a third MSPS. C4 can be a fourth MSPS. C5 can be a fifth MSPS. As shown in FIG. 4, C2 is between C1 and C3, C3 is between C2 and C4, and C4 is between C3 and C5.

For each symbol in a selected symbol set, the example embodiments can include machine 100 randomly determining a corresponding arrangement position so as to form a first arrangement of the selected symbol set. As such, in an example where the arrangement is a column-and-row arrangement, machine 100 may randomly determine a column identifier and a row identifier (from a set of potential column identifier and row identifier combinations) for each symbol in the selected symbol set. In an example where the arrangement has symbol position identifiers, machine 100 may randomly select a symbol position identifier for each symbol in the selected symbol set. For instance, for an arrangement with 15 symbol positions, the numerical identifiers can be whole numbers 1 through 15, inclusive. The processors or machines described herein can be configured to select a symbol position using a random number generator that is configured to generate a number within the range 1 through 15.

As further shown in FIG. 4, the selected symbol set 400 includes: symbols S1, S2, and S6 at rows R1, R2, and R3, respectively, of column C1; symbols S2, S2, and S4 at rows R1, R2, and R3, respectively, of column C2; symbols S3, S3, and S6 at rows R1, R2, and R3, respectively, of column C3; symbols S4, S5, and S3 at rows R1, R2, and R3, respectively, of column C4; and symbols S4, S1, and S2 at rows R1, R2, and R3, respectively, of column C5. Other arrangements of symbols, in terms of the number of columns, number of rows, or the layout of symbols, are possible.

Figure 5:
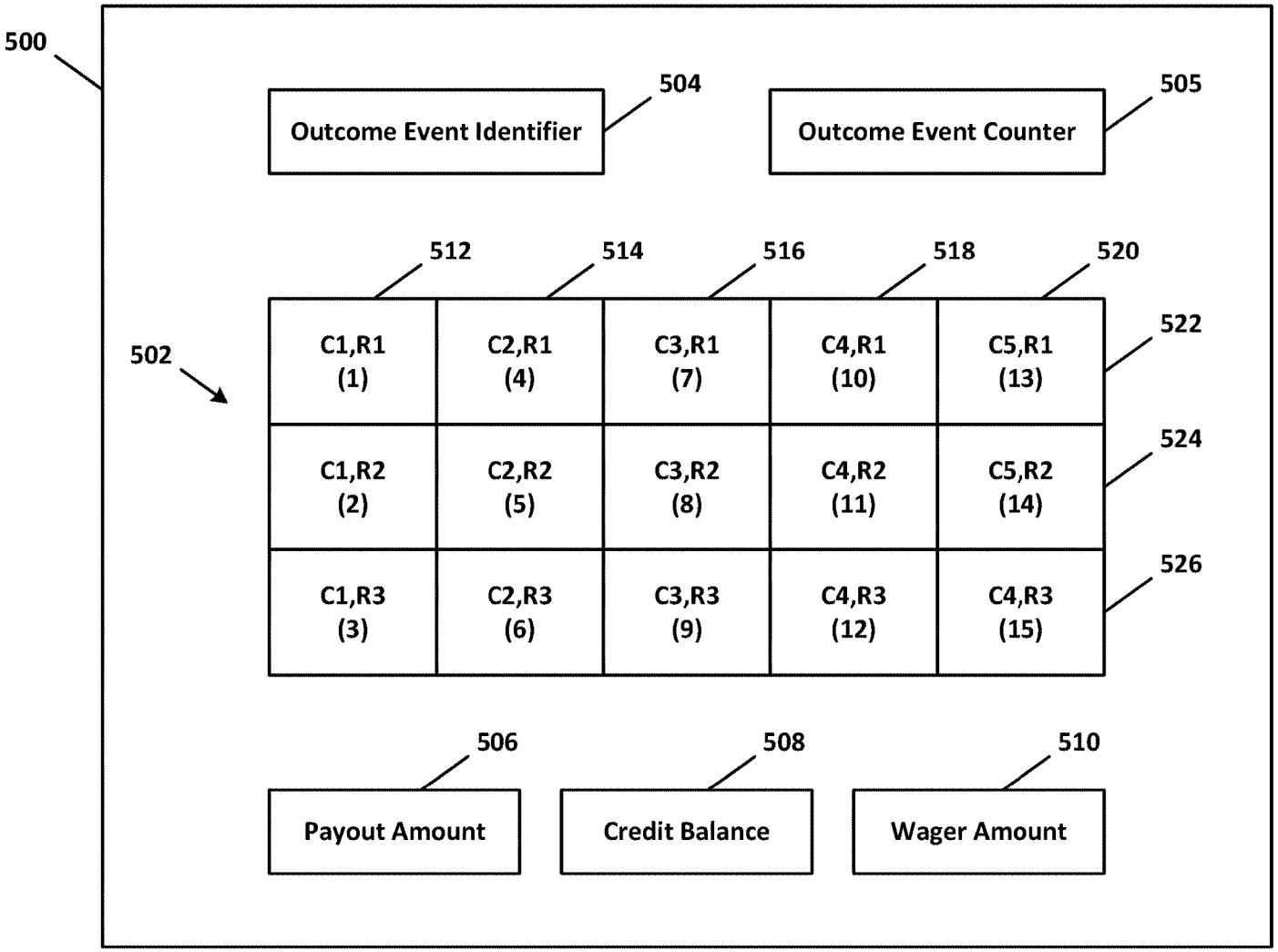
FIG. 5 depicts elements displayable by a display of a machine, in accordance with example embodiments.

FIG. 5 depicts a screenshot 500 that machine 100, server machine 100*a*, or client machine 100*b* can visually present (i.e., display) using displays 110, 110*a*, and 110*b*, respectively. For purposes of this description, each element of screenshot 500 can be a displayable element of the display. Screenshot 500 includes a symbol-display-portion 502, an outcome event identifier 504, an outcome event counter 505, a payout amount indicator 506, a credit balance indicator 508, and a wager amount indicator 510.

Symbol-display-portion 502 can include multiple symbol-display-segments and multiple symbol positions where selected symbols of a symbol set can be displayed. As an example, the symbol-display-segments can include vertical symbol-display-segments 512, 514, 516, 518, and 520 (or more simply, vertical SDSs 512-520). As another example, the symbol-display-segments can include horizontal symbol-display-segments 522, 524, and 526 (or more simply, horizontal SDSs 522-526). Each symbol-display-segment can include multiple symbol positions. The vertical SDSs 512-520 are shown in FIG. 5 as having three symbol positions. The horizontal SDSs 522-526 are shown in FIG. 5 as having five symbol positions. A person skilled in the art will understand that those symbol-display-segments can be configured with different numbers of symbol positions than shown in FIG. 5.

The vertical SDSs 512-520 can be configured as spinnable reels. The processor of a machine or system displaying screenshot 500 can display the spinnable reels spinning and stopped after spinning. For vertical SDSs 512-520, the spinnable reels may spin in a vertical direction (e.g., top to bottom or bottom to top, with respect to the symbol-display-portion 502).

The horizontal SDSs 522-526 can be configured as spinnable reels. The processor of a machine or system displaying screenshot 500 can display the spinnable reels spinning and stopped after spinning. For horizontal SDSs 522-526, the spinnable reels may spin in a horizontal direction (e.g., left to right or right to left, with respect to the symbol-display-portion 502).

Machine 100 can cause symbol-display-segments to spin, and cause spinning symbol-display-segments to stop spinning. The spinning and stopping of the spinning symbol-display-segments can be carried out for each outcome event. In accordance with the embodiments in which the symbol-display-portion 502 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

The processor of the machines or systems described herein can determine a state the machine or system is operating in or an outcome event that can occur during the determined state of the machine or system. In response to making that determination, the processor can cause the outcome event identifier 504 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 510, the determined payout amount to be displayed by the payout amount indicator 506, the determined credit balance to be displayed by the credit balance indicator 508, and the number of awarded remaining outcome events to be displayed by the outcome event counter 505.

III. Example Reel-Based Game

Figure 6A:
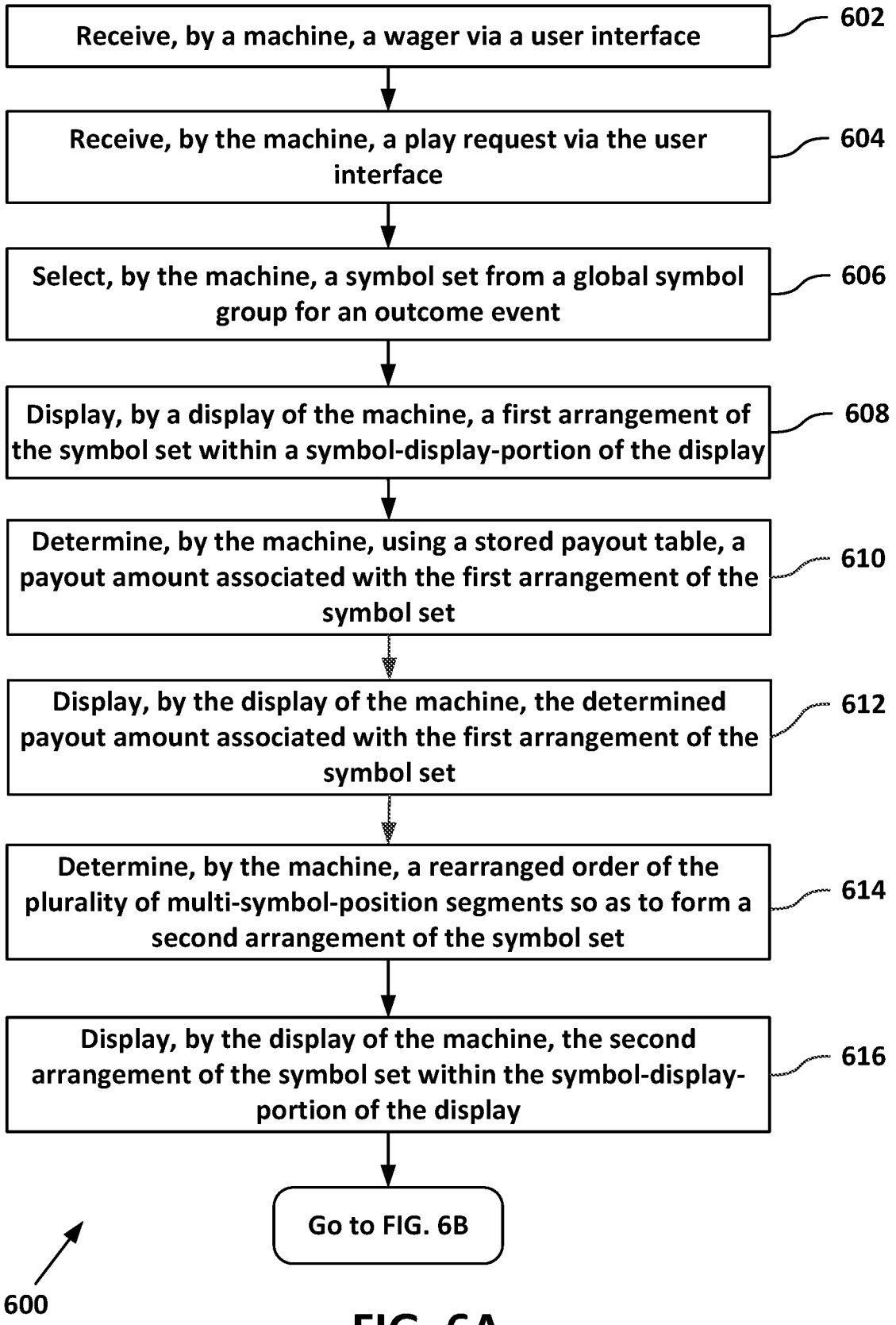
FIG. 6A is a first part of a flow chart, in accordance with example embodiments.
Figure 6B:
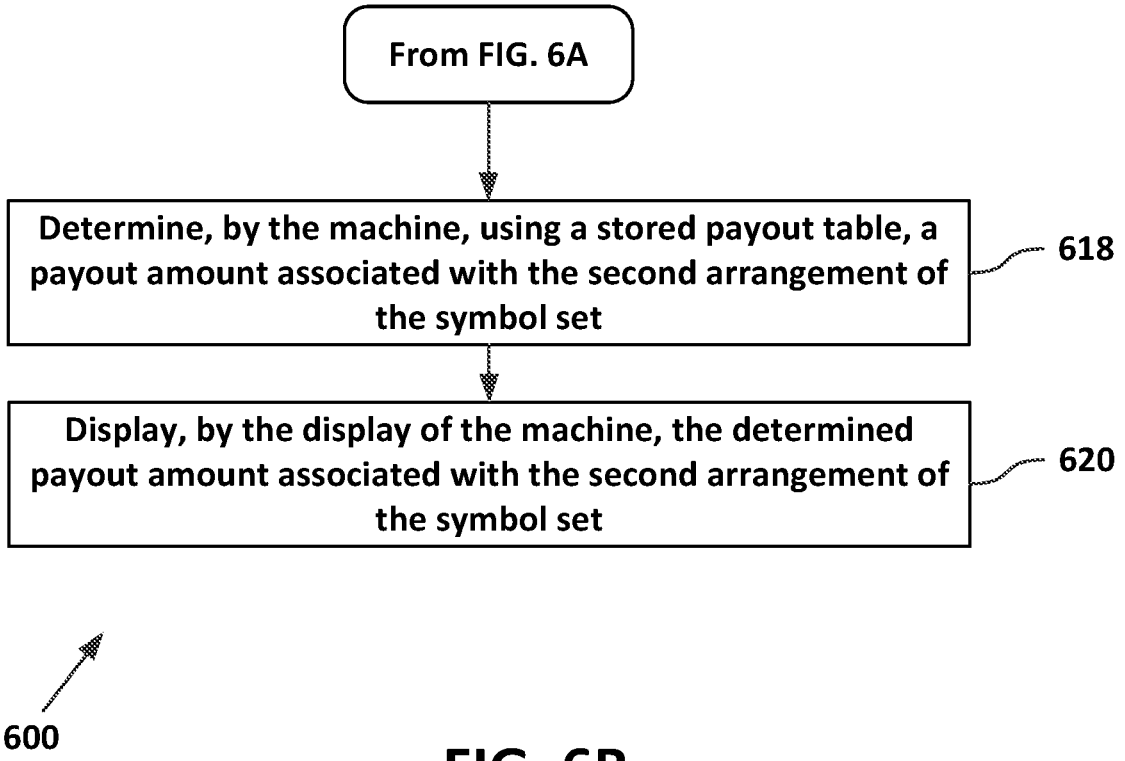
FIG. 6B is a second part of the flow chart of FIG. 6A, in accordance with example embodiments.

FIGS. 6A and 6B depict a flow chart showing a set of operations 600 (or more simply, "the set 600") that can, for example, be carried out using machine 100. Nonetheless, some or all of these operations may be carried out on server machine 100*a* and/or client machine 100*b*.

The operations of the set 600 are shown within blocks labeled with even integers between 602 and 620, inclusive, and can pertain to a method in connection with machine 100. The example method can relate to performing an outcome event, such as a wager game. Any other operation(s) described herein as being performed by machine 100 can be performed prior to, while, or after performing any one or more of the operations of the set 600, unless context clearly dictates otherwise. Those other operation(s) can be performed in combination with or separately from any one or more of the operations of the set 600. Any operation described below, or elsewhere in this description, with respect to FIG. 6A and/or FIG. 6B, can be performed, at least in part, by a processor, such as processor 112 executing software program instructions.

Turning to FIG. 6A, block 602 includes receiving, by machine 100, a wager via the user interface 104. In one example, the user interface 104 may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a number of bonus outcome events.

A player using machine 100 may have a corresponding player credit balance, from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 508 and a received wager amount in wager amount indicator 510.

Next, block 604 includes receiving, by machine 100, a play request (e.g., a "spin" request) via the user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event.

Next, block 606 includes selecting, by machine 100, a symbol set from a global symbol group for the outcome event. Determining the symbol set can include processor 112 carrying out a random selection, such as a random selection of the symbol set from the global symbol group. Selecting the symbol set can include associating symbols with respective symbol positions. There can be a plurality of multi-symbol-position segments, and each of the symbols can be associated with a respective symbol position within a multi-symbol-position segment. Further, the multi-symbol-position segments can be arranged in a first order so as to form a first arrangement of the symbol set.

In some embodiments, the respective pluralities of symbols for the reels may be arranged in respective cyclical sequences of symbols. With this configuration, selecting the set of symbols may involve, for each reel, randomly selecting a respective reel position such that a respective subsequence of the symbols thereon are in the set of symbols. For instance, for a first reel, a first reel position may be selected, and the first reel position may correspond to symbols 1, 2, and 3 of a subsequence of symbols being selected. Or, for the first reel, a third reel position may be selected, and the third reel position may correspond to symbols 3, 4, and 5 of the subsequence of symbols being selected.

Next, block 608 includes displaying, by a display of the machine 100, a first arrangement of the symbol set within a symbol-display-portion of the display 110.

Figure 7:
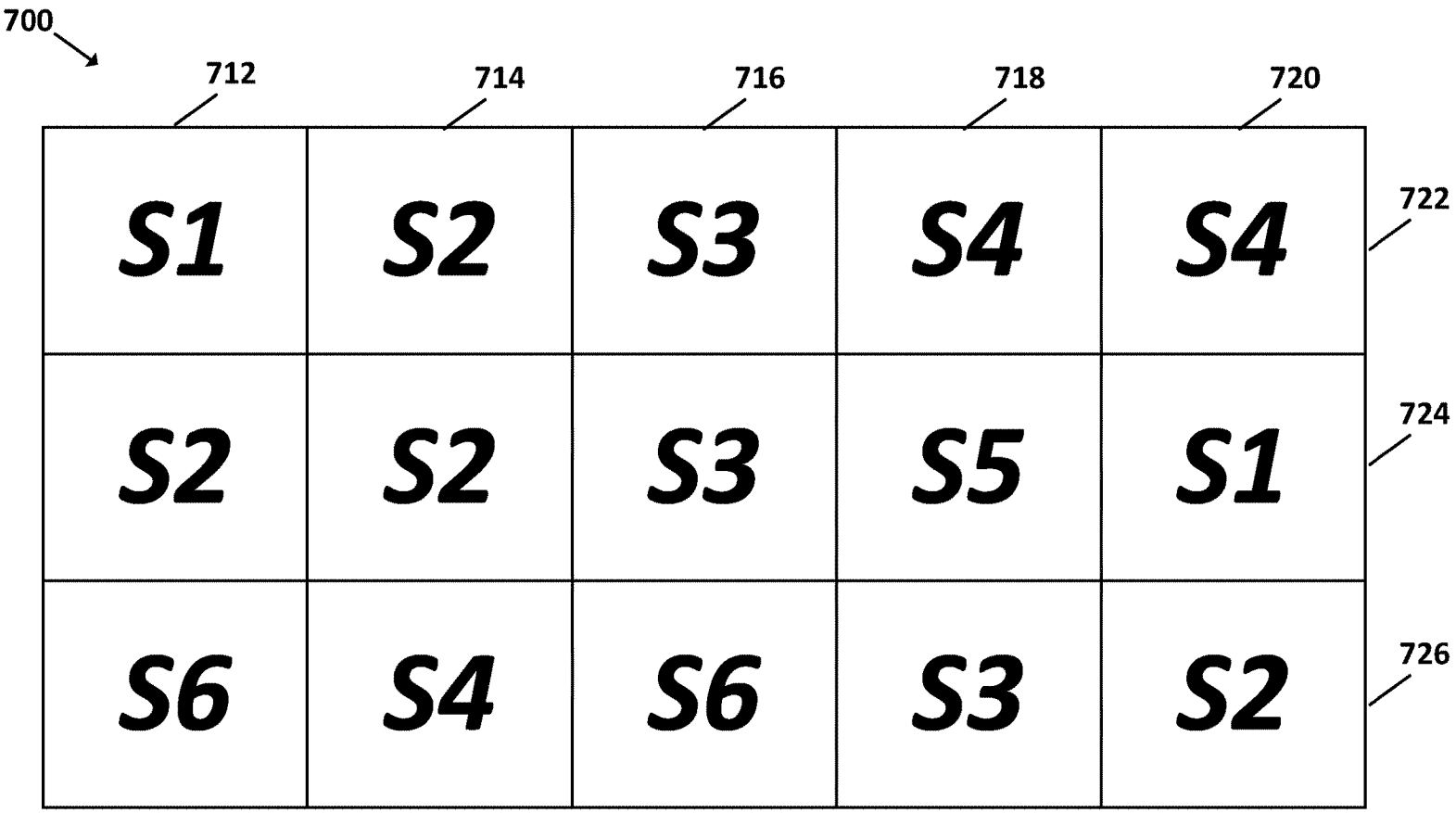
FIG. 7 depicts an example of a selected symbol set in a display, in accordance with example embodiments.

FIG. 7 shows an example of a first arrangement 700 of a symbol set from the global symbol group for display during an outcome event. The first arrangement 700 of the symbol set includes five vertical MSPSs 712-720 and three horizontal MSPSs 722-726. The symbol set includes (i) two S1 symbols at arrangement positions C1,R1 and C5,R2; (ii) four S2 symbols at arrangements positions C1,R2, C2,R1, C2,R2, and C5,R3; (iii) three S3 symbols at arrangement positions C3,R1, C3,R2, and C4,R3; (iv) three S4 symbols at arrangement positions C2,R3, C4,R1, and C5,R1; (v) a single S5 symbol at arrangement position C4,R2; and (vi) two S6 symbols at arrangement positions C1,R3 and C3,R2.

Referring back to FIG. 6A, optionally, block 610 includes determining, by machine 100, a payout amount associated with the first arrangement of the symbol set. In one example, the payout amount may be determined randomly by machine 100. In another example, the payout amount may be determined by the machine 100 using a stored payout table (not shown) as a function of the received wager and the positions of the symbols in the first arrangement of the symbol set. In some instances, the first arrangement of the symbol set might not include any winning combinations. Accordingly, the operation at block 610 might not be performed. In other examples, determining the payout amount could include determining a payout amount of zero upon determining that there are not any winning combinations in the first arrangement of the symbol set.

Next, optionally, block 612 includes displaying, by the display of machine 100, the determined payout amount associated with the first arrangement of the symbol set. For example, where machine 100 has determined, using the stored payout table, a payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount. Where the payout amount is zero, the display can display an indication that the payout amount is zero.

Next, block 614 includes determining, by machine 100, a rearranged order of the plurality of multi-symbol-position segments so as to form a second arrangement of the symbol set, and block 616 includes displaying, by the display of machine 100, the second arrangement of the symbol set within the symbol-display-portion of the display.

Figure 8:
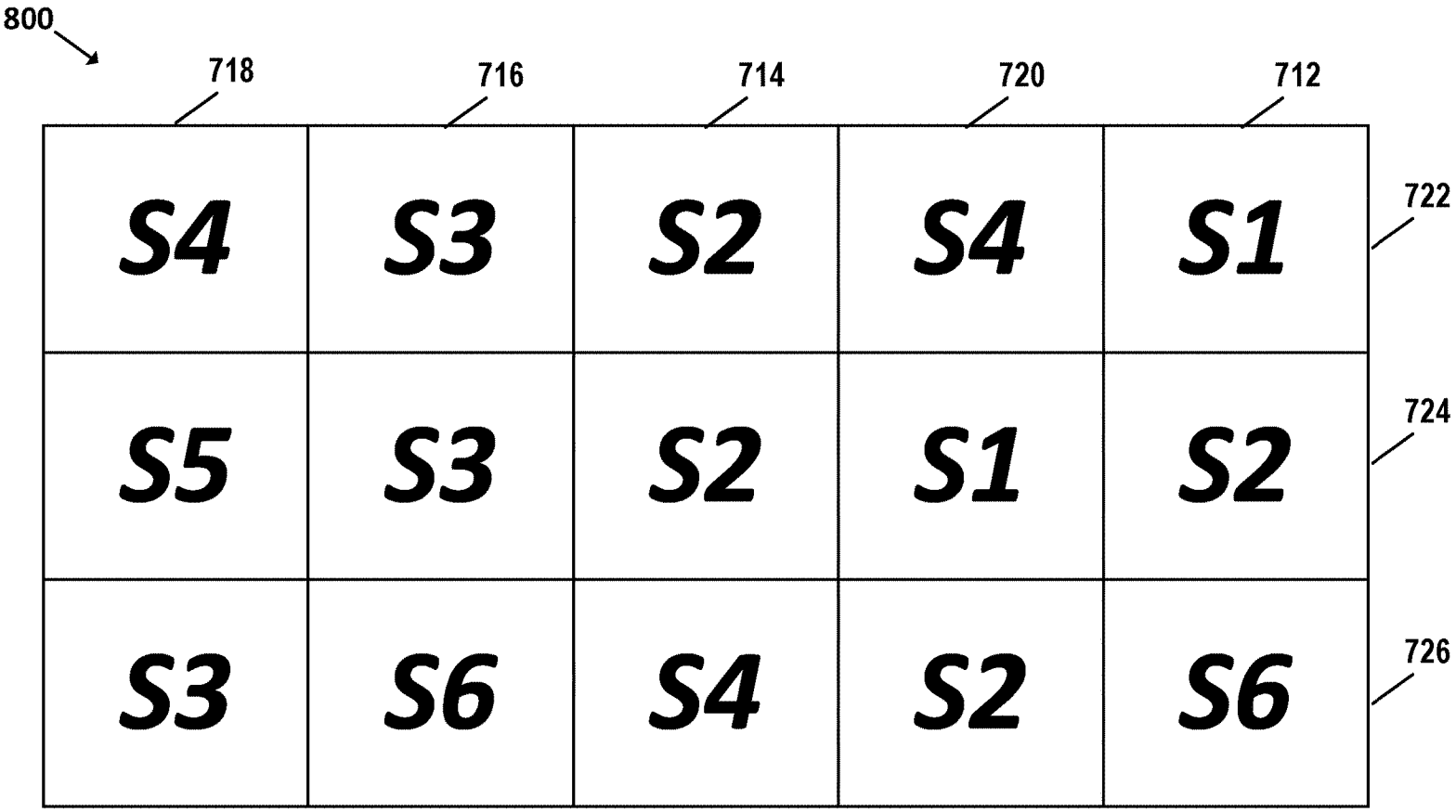
FIG. 8 depicts an example of a different arrangement of the symbol set of FIG. 7, in accordance with example embodiments.

Determining the rearranged order can involve determining a second order of the multi-symbol-position segments that is different from the first order, and doing so without altering which symbols are associated with each respective multi-symbol-position segment or doing so without altering which symbols are associated with each respective symbol position. By way of example, FIG. 8 shows an example of a second arrangement of the symbol set. As evident when comparing FIGS. 7 and 8, the vertical MSPSs 712-720 are in a first order in the first arrangement 700 and in a second order in the second arrangement 800 that is different from the first order. In FIG. 7, the vertical MSPSs 712-720 are arranged, from left to right, in the following order: vertical MSPS 712, vertical MSPS 714, vertical MSPS 716, vertical MSPS 718, vertical MSPS 720. Whereas, in the second arrangement 800, the vertical MSPSs 712-720 are arranged, from left to right, in the following order: vertical MSPS 718, vertical MSPS 716, vertical MSPS 714, vertical MSPS 720, vertical MSPS 712.

Further, note that although the order of the vertical MSPSs 712-720 is rearranged in the second arrangement 800 as compared to the first arrangement 700, the symbols that are associated with each respective symbol position within the vertical MSPSs 712-720 are the same in the first arrangement 700 and the second arrangement 800. In other examples, when determining the rearranged order of the vertical MSPSs, machine 100 may alter which symbols are associated with each respective symbol position within one or more of the vertical MSPSs 712-720 (not shown). For instance, after moving vertical MSPS 712 from the leftmost position in the row-and-column grid arrangement to the rightmost position in the row-and-column grid arrangement, machine 100 may also change which symbol is associated with each row within vertical MSPS 712. As an example, machine 100 could swap the symbol positions of a first symbol associated with a first row of vertical MSPS 712 and a second symbol associated with a second row of vertical MSPS 712.

In other examples, machine 100 can determine a rearranged order of the horizontal MSPSs 722-726. It is also possible that determining the rearranged order can involve rearranging one or more of the vertical MSPSs 712-720 and then rearranging one or more of the horizontal MSPSs 722-726, or involve rearranging one or more of the horizontal MSPSs 722-726 and then rearranging one or more of the vertical MSPSs 712-720.

Machine 100 can determine the second order of the multiple-symbol-position segments in various ways. As one example, machine 100 can randomly determine the second order. Randomly determining the second order can involve assigning different respective integers to each of the multiple-symbol-position segments, and then randomly generating a sequence of the different respective integers without replacement. For instance, with reference to FIG. 7, machine 100 can assign integer one to vertical MSPS 712, integer two to vertical MSPS 714, integer three to vertical MSPS 716, integer four to vertical MSPS 718, and integer five to vertical MSPS 720. Machine can then randomly generate a sequence of the integers 1-5 without replacement. An example sequence could be 2, 5, 4, 3, 1. Machine 100 could then rearrange the vertical MSPSs 712-720 according to the generated sequence.

Alternatively, randomly determining the second order can involve randomly selecting a multi-symbol-position segment of the plurality of multi-symbol-position segments, and altering a location within the first order of the selected multi-symbol-position segment so as to determine the second order. For instance, machine 100 could randomly select horizontal MSPS 724, which is arranged between horizontal MSPS 722 and horizontal MSPS 726 in the first arrangement 700, and rearrange horizontal MSPS 724 such that it is no longer in the same location. Machine 100 could accomplish this by swapping the position of horizontal MSPS 722 with the position of horizontal MSPS 724.

Further, as another example, machine 100 could randomly determine the second order by randomly selecting a first multi-symbol-position segment and a second multi-symbol-position segment, and swapping respective locations within the first order of the first multi-symbol-position segment and the second multi-symbol-position segment so as to determine the second order. Still further, machine 100 could randomly determine the second order by randomly selecting the second order from a plurality of permutations of the first order. For instance, the first order of the vertical MSPSs 712-720 in the first arrangement 700 from left to right is vertical MSPS 712, vertical MSPS 714, vertical MSPS 716, vertical MSPS 718, vertical MSPS 720. Two examples of permutations of the first order are: vertical MSPS 714, vertical MSPS 712, vertical MSPS 716, vertical MSPS 718, vertical MSPS 720; and vertical MSPS 714, vertical MSPS 716, vertical MSPS 712, vertical MSPS 718, vertical MSPS 720. Machine 100 could determine the second order by randomly selecting one of the two permutations of the first order.

In other examples, machine 100 can determine the second order using a deterministic approach. For example, machine 100 can determine the second order by reversing the first order, determine the second order by swapping positions of the first and last horizontal MSPSs, or determine the second order by moving the vertical MSPS that is in the last position from the last position to the first position, and shifting each of the other vertical MSPSs to the right by one position.

With a symmetrical grid of symbol positions, each vertical MSPS may have the same number of positions as each horizontal MSPS. Accordingly, machine 100 could determine the second order by swapping respective locations of a vertical MSPS and a horizontal MSPS.

In some examples, machine 100 can encounter a trigger to rearrange the first order, and then determine the second order in response to encountering the trigger. For instance, the rearranging at block 614 could be a feature that is triggered whenever the trigger is encountered but does not occur if the trigger is not encountered. The trigger could be a randomly occurring event, such as an event that randomly occurs during performance of at least some outcome events. For example, the trigger could be the presence of at least one or more than a threshold number of trigger symbols in the selected symbol set. The trigger symbol could be a Wild symbol. As another example, encountering the trigger could involve determining that the first arrangement of the symbol set includes a winning combination, or determining that the first arrangement of the symbol set does not include a winning combination.

Referring back to FIG. 6B, optionally, block 618 includes determining, by machine 100, a payout amount associated with the second arrangement of the symbol set. In one example, the payout amount may be determined randomly by machine 100. In another example, the payout amount may be determined by the machine 100 using a stored payout table (not shown) as a function of the received wager and the symbols in the displayed second arrangement of the symbol set. In some instances, the second arrangement of the symbol set might not include any winning combinations. Accordingly, the operation at block 618 might not be performed. In other examples, determining the payout amount could include determining a payout amount of zero upon determining that there are not any winning combinations in the second arrangement of the symbol set.

In some cases, the first arrangement of the symbol set might not include a winning combination, but the second arrangement of the symbol set might include a winning combination. Thus, by providing the second arrangement, a payout amount that, but for the second arrangement would not have been provided, can be paid out to a player. In other examples, the first arrangement of the symbol set might include a winning combination but the second arrangement of the symbol set might not include a winning combination. Similarly, both the first arrangement and the second arrangement can include winning combinations (e.g., either the same winning combination(s) or different winning combination(s)), or neither the first arrangement nor the second arrangement may include a winning combination.

Next, optionally, block 620 includes displaying, on the display 110, the determined payout amount associated with the second arrangement of the symbol set. The determined payout amount associated with the second arrangement of the symbol set can be added to any payout amount associated with the first arrangement of the symbol set so as to create a total payout amount, and the total payout amount can be paid out.

In some examples, the machine 100 may also physically dispense a corresponding payout amount (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

Notably, the operation of rearranging symbols that appear on reels of a reel-based game, without spinning the reels, necessitates computer implementation. In a mechanical reel-based game, the symbols appearing on each reel are fixed and cannot be changed mid-game. In contrast, the computer implementation herein allows the symbols appearing on each reel to be rearranged during a game. Such a change can occur mid-game, for example between spins of the reels or at the end of a game, for example after a spin and based on the symbols identified for the different reels. Consequently, these features of the disclosure herein would not exist but for computer technology.

Particularly, the embodiments herein solve a technical problem of how to add movement to individual symbols of a reel-based game in the reel-based game. The operations of reordering segments of symbols of a selected symbol set would be prohibitively complex and expensive to implement on a traditional machine with mechanical reels. In effect, the present approach can be seen as providing an implementation which increases the number and variety of possible outcomes in a random selection of data entries based on a reel-based game of luck.

Further, these features are an improvement to reel-based gaming technology. For example, embodiments that involve rearranging an order of multi-symbol-position segments clearly involve a computerized implementation. Since the symbols appearing on each reel are fixed and cannot be changed mid-game in mechanical reel-based games, the operations of reordering segments of symbols could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

IV. Example Operations

Figure 9A:
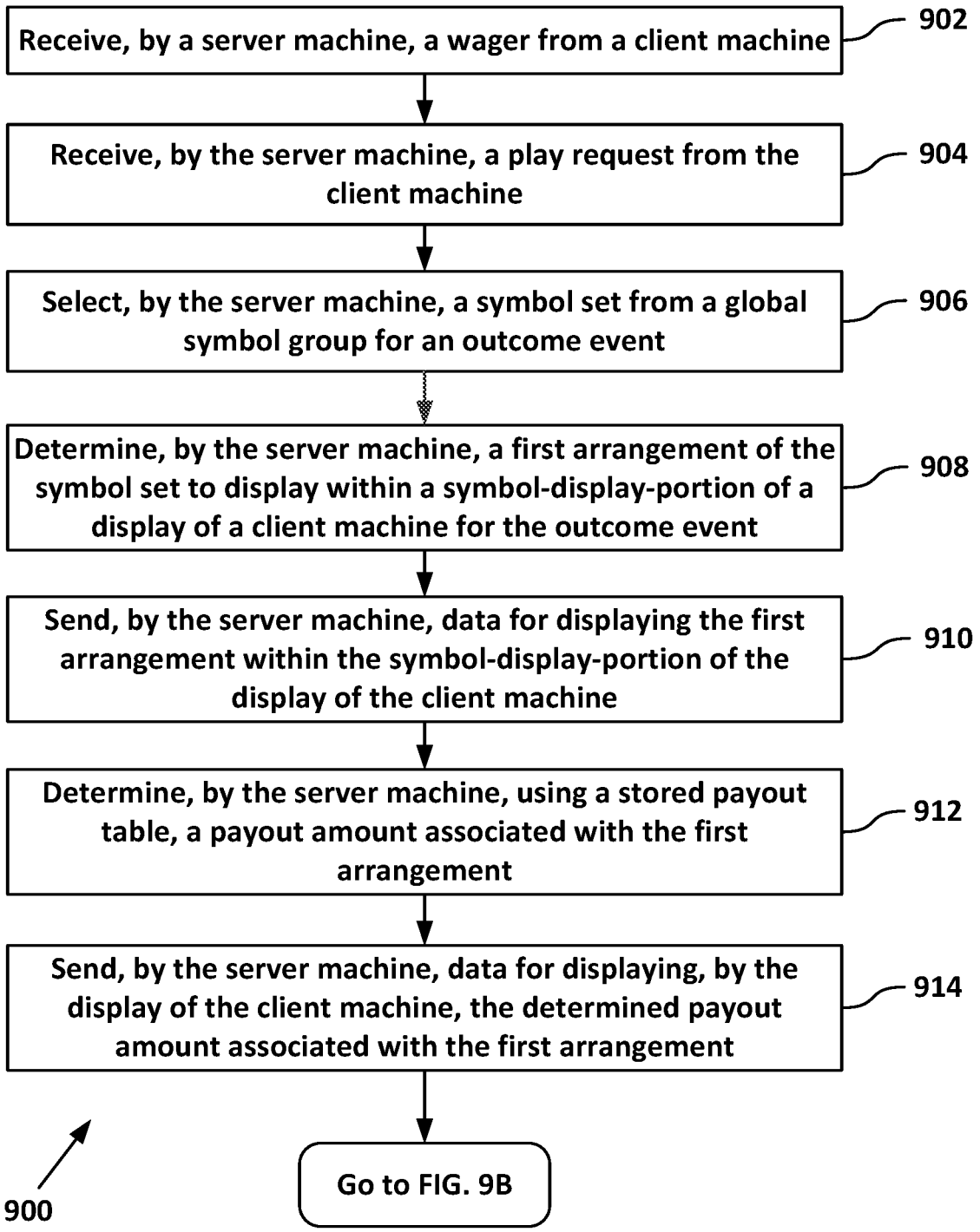
FIG. 9A is a first part of a flow chart, in accordance with example embodiments.
Figure 9B:
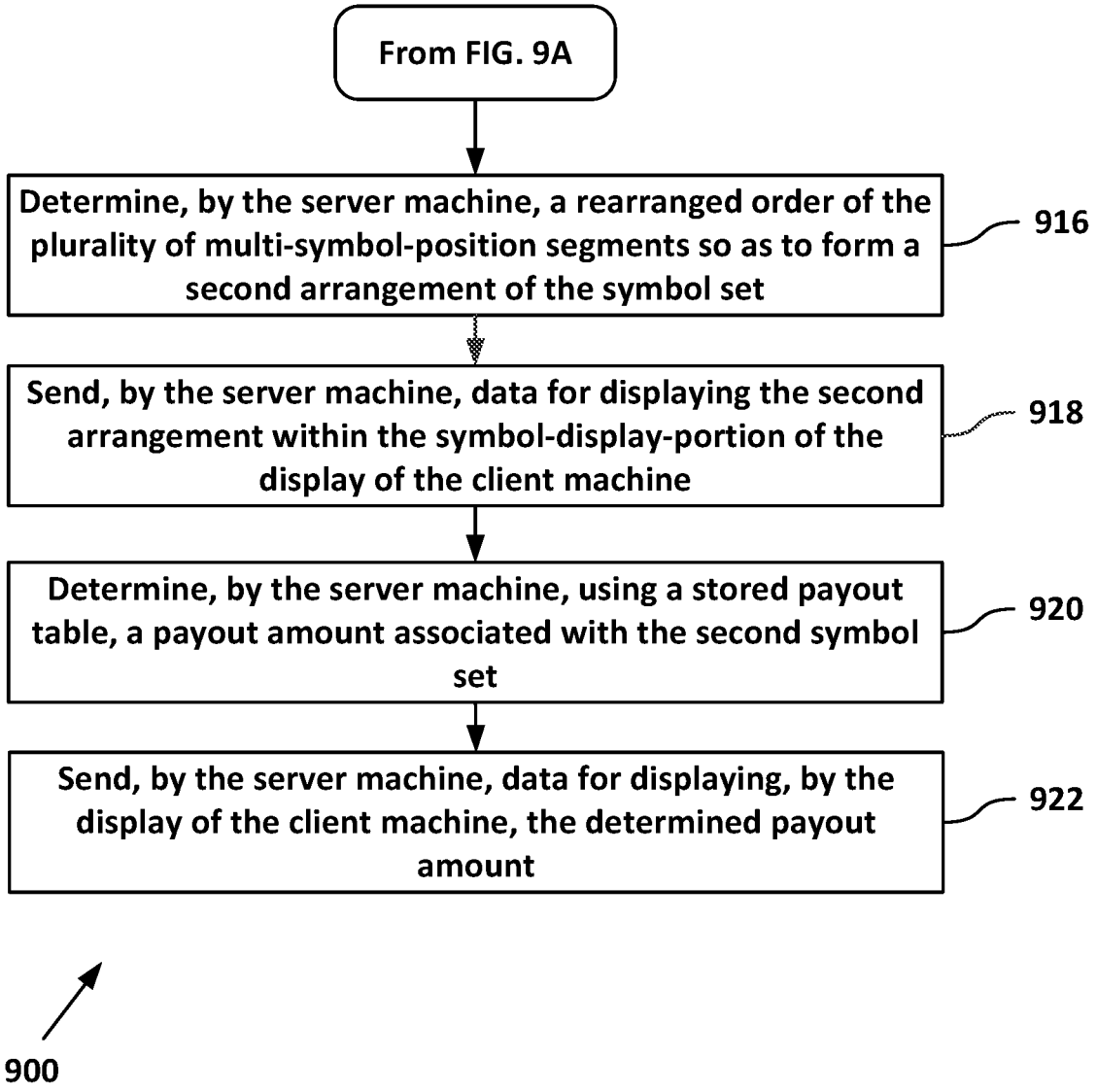
FIG. 9B is a second part of the flow chart of FIG. 9A, in accordance with example embodiments.

FIGS. 9A and 9B depict a flowchart showing a set of operations 900 (or more simply, "the set 900") that can, for example, be carried out using server machine 100*a*. Note that several of the operations described in connection with FIGS. 9A and 9B parallel operations described in connection with FIGS. 6A and 6B. As such, variations of the operations described in connection with FIGS. 6A and 6B are likewise applicable to the operations described in connection with FIGS. 9A and 9B. However, for the sake of brevity, these variations are not repeated. The server machine 100*a*, in performing the set 900, can perform the operations described above with respect to machine 100.

Turning to FIG. 9A, block 902 includes receiving, by the server machine 100*a*, a wager from the client machine 100*b*.

Next, block 904 includes receiving, by the server machine 100*a*, a play request from the client machine 100*b*.

Next, block 906 includes selecting, by the server machine 100*a*, a symbol set from a global symbol group for an outcome event.

Next, block 908 includes determining, by the server machine 100*a*, a first arrangement of the symbol set to display within the symbol-display-portion of the display 110*b* of the client machine 100*b* for the outcome event.

Next, block 910 includes sending, by the server machine 100*a*, data for displaying the first arrangement within the symbol-display-portion of the display 110*b* of the client machine 100*b*. The data for displaying the first arrangement could take the form of a representation of the first arrangement of the symbol set. For instance, the server machine 100*a* could send to client machine 100*b* a list of symbols in the symbol set or symbol identifiers for symbols in the symbol set. The symbols could be ordered in the list in accordance with arrangement positions for the symbols. As an example, there may be 15 symbol positions and the first symbol in the list may correspond to the first symbol position, the second symbol in the list could correspond to the second symbol position, and so forth. Alternatively, the server machine 100*a* could send to client machine 100*b* a list of symbols and a list of arrangement positions for the respective symbols.

In some examples, a memory, such as a memory of the server machine 100*a*, more store respective pluralities of symbols for reels. The respective pluralities of symbols for the reels may be arranged in respective cyclical sequences of symbols, and selecting the symbol set can include selecting respective reel positions for the reels, such that respective subsequences of the symbols on the reels are in the symbol set. With this approach, the data for displaying the first arrangement can include respective reel positions for each of the reels, which the client machine 100*b* can interpret to determine the symbols in the symbol set and the arrangement positions of the symbols in the symbol set. For instance, server machine 100*a* could transmit to client machine 100*b* five reel positions for five respective reels, such as: reel position 4, reel position 8, reel position 2, reel position 1, and reel position 1.

Next, optionally, block 912 includes determining, by the server machine 100*a* using a stored payout table, a payout amount associated with the first arrangement.

Next, optionally, block 914 includes sending, by the server machine 100*a*, data for displaying, by the display 110*b* of the client machine 100*b*, the determined payout amount associated with the first arrangement.

In some instances, the server machine 100*a* could send together (e.g., within the same data packet or group of data packets) to the client machine 100*b*, the data for displaying the first arrangement and the data for displaying the determined payout. This can reduce the number of transmissions between the server machine 100*a* and the client machine 100*b*.

Turning now to FIG. 9B, block 916 includes determining, by the server machine 100*a*, a rearranged order of the plurality of multi-symbol-position segments so as to form a second arrangement of the symbol set.

Next, block 918 includes sending, by the server machine 100*a*, data for displaying the second arrangement within the symbol-display-portion of the client machine 100*b*. The form of the data for displaying the second arrangement could be similar to the form of the data for displaying the first arrangement described above with reference to block 910. For instance, server machine 100*a* could send to client machine 100*b* a list of symbols or symbol identifiers and their corresponding arrangement positions, an ordered list of symbols or symbol identifiers that are ordered in accordance with their arrangement positions, or a list of reel positions for different respective reels.

Alternatively, to limit the amount of data sent between the server machine 100*a* and the client machine 100*b*, the data for displaying the second arrangement could only include symbols whose arrangement positions have changed between the first arrangement and the second arrangement. For instance, if symbols at arrangement positions 1, 2, 3, 7, 8, and 9 have changed but symbols at arrangement positions 4, 5, 6, 10, 11, 12, 13, 14, and 15 have not changed, server machine 100*a* could send to client machine 100*b* a list of symbols (or symbol identifiers) and their respective arrangement positons for the symbols associated with arrangement positions 1, 2, 3, 7, 8, and 9. Similarly, the representation of the second arrangement could take the form of a list of reels and reel positions for any symbols whose arrangement positions have changed between the first arrangement and the second arrangement.

In another example, the data for displaying the second arrangement could indicate a rearranged order of MSPSs. For instance, there may be five MSPSs corresponding to five respective columns in a row-and-column arrangement of symbols, and the data could indicate to swap a first MSPS with a second MSPS such that symbols associated with the first MSPS are swapped with symbols associated with the second MSPS. Additionally or alternatively, there may be three MSPSs corresponding to three respective rows, and the data indicate to move a first MSPS to a second row, move a second MSPS to the third row, and move a third MSPS to the first row.

In some embodiments, the data for displaying the first arrangement and the data for displaying the second arrangement could be sent to the client machine 100*b* together. For instance, the second arrangement of the symbol set could be determined before sending the data for displaying the first arrangement to the client machine 100*b*, and after the second arrangement of the symbol set is determined, the server machine 100*a* could send to the client machine 100*b* data indicative of both the first arrangement and the second arrangement of the symbol set. One example of data indicative of both the first arrangement and the second arrangement is a list of symbols or symbol identifiers, a first list of arrangement positions for the respective symbols corresponding to the first arrangement, and a second list of arrangement positions for the respective symbols corresponding to the second arrangement. Another example of data indicative of both the first arrangement and the second arrangement is a first ordered list of symbols or symbol identifiers that are ordered in accordance with their arrangement positions in the first arrangement, and a second ordered list of the symbols or symbol identifiers that is ordered in accordance with their arrangement positions in the second arrangement. Still another example of data indicative of both the first arrangement and the second arrangement is a first list of reels and reel positions corresponding to the first arrangement, and a second list of reels and reel positions for any symbols whose arrangement positions have changed between the first arrangement and the second arrangement. Other examples are also possible.

Next, optionally, block 920 includes determining, by the server machine 100*a* using a stored payout table, a payout amount associated with the second arrangement.

Next, optionally, block 922 includes sending, by the server machine 100*a*, data for displaying, by the display 110*b* of the client machine 100*b*, the determined payout amount associated with the second arrangement. In line with the discussion above, the data for displaying the determined payout amount associated with the second arrangement could be sent together with the data for displaying the second arrangement.

In one embodiment, data for displaying the first arrangement, data for displaying the payout amount associated with the first arrangement, data for displaying the second arrangement, and data for displaying the payout amount associated with the second arrangement could all be sent to the client machine 100*b* together. This could reduce the number of transmissions between the server machine 100*a* and the client machine 100*b*, and could also allow the client machine 100*b* to display the outcome event faster since the client machine 100*b* could receive all of the information for displaying the first arrangement, the second arrangement, and the payout amounts prior to displaying the first arrangement. Note that a payout amount, such as the payout amount associated with the first arrangement and/or the payout amount associated with the second arrangement could be zero if there is not a winning combination.

Figure 10A:
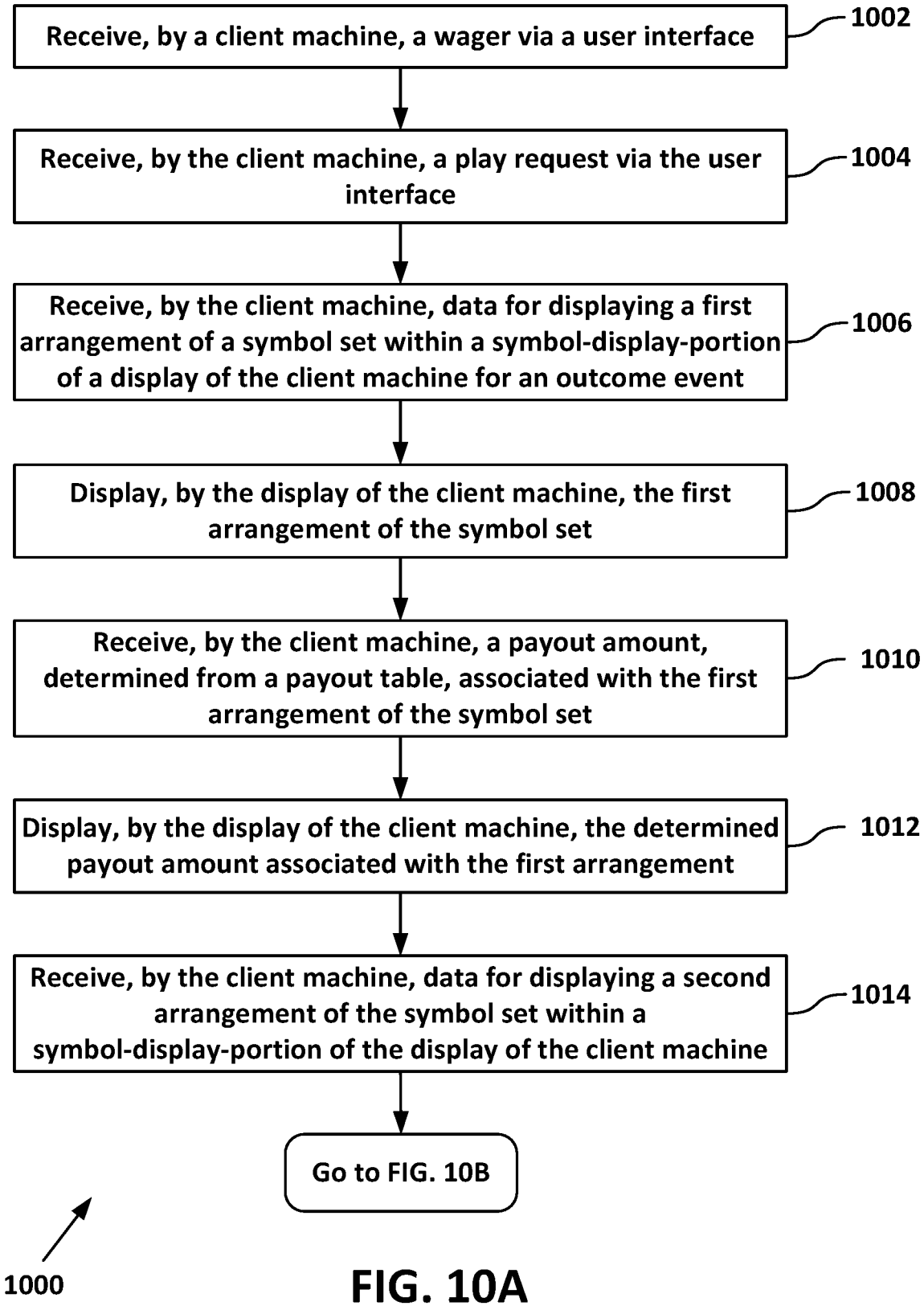
FIG. 10A is a first part of a flow chart, in accordance with example embodiments.
Figure 10B:
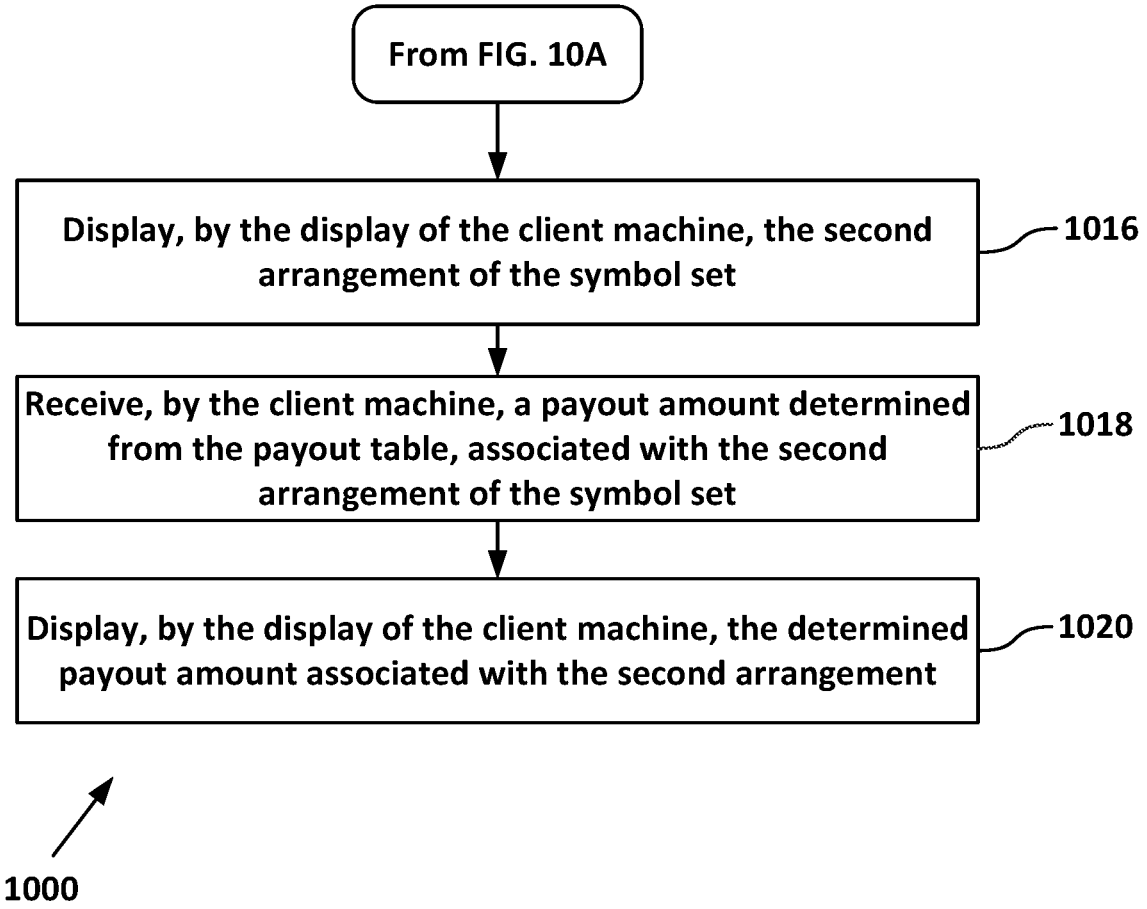
FIG. 10B is a second part of the flow chart of FIG. 10A, in accordance with example embodiments.

FIGS. 10A and 10B depict a flowchart showing a set of operations 1000 (or more simply, "the set 1000") that can, for example, be carried out using client machine 100*b*. Note that several of the operations described in connection with FIGS. 10A and 10B parallel operations described in connection with FIGS. 6A and 6B and FIGS. 9A and 9B. As such, variations of the operations described in connection with FIGS. 6A and 6B and FIGS. 9A and 9B are likewise applicable to the operations described in connection with FIGS. 10A and 10B. However, for the sake of brevity, these variations are not repeated. The client machine 100*b*, in performing the set 1000, can perform the operations described above with respect to machine 100.

Turning to FIG. 10A, block 1002 includes receiving, by the client machine 100*b*, a wager via the user interface 104*b*. Client machine 100*b* can transmit the received wager or data indicative thereof over the communication network 116 to server machine 100*a*.

Next, block 1004 includes receiving, by the client machine 100*b*, a play request via the user interface 104*b*. Client machine 100*b* can transmit the received play request or data indicative thereof over the communication network 116 to server machine 100*a*.

Next, block 1006 includes receiving, by the client machine 100*b*, data for displaying a first arrangement of a symbol set within a symbol-display-portion of a display of the client machine 100*b* for an outcome event.

Next, block 1008 includes displaying, by the display of the client machine 100*b*, the first arrangement of the symbol set.

Next, block 1010 includes receiving, by the client machine 100*b*, a payout amount, determined from a payout table, associated with the first arrangement of the symbol set.

Next, block 1012 includes displaying, by the display 110*b* of the client machine 100*b*, the determined payout amount associated with the first arrangement of the symbol set.

Next, block 1014 includes receiving, by the client machine 100*b*, data for displaying a second arrangement of the symbol set within a symbol-display-portion of the display of the client machine.

Turning to FIG. 10B, next, block 1016 includes displaying, by the display of the client machine 100*b*, the second arrangement of the symbol set.

In some embodiments, the display 110*b* of the client machine 100*b* might not display the first arrangement of the symbol set until after receiving both the data for displaying the first arrangement of the symbol set and the data for displaying the second arrangement of the symbol set (not shown). Further, the data for displaying the first arrangement of the symbol set may be received together with the data for displaying the second arrangement of the symbol set.

Next, block 1018 includes receiving, by the client machine 100*b*, a payout amount, determined from the payout table, associated with the second arrangement of the symbol set.

Next, block 1020 includes displaying, by the display of the client machine 100*b*, the determined payout amount associated with the second arrangement of the symbol set.

Figure 11:
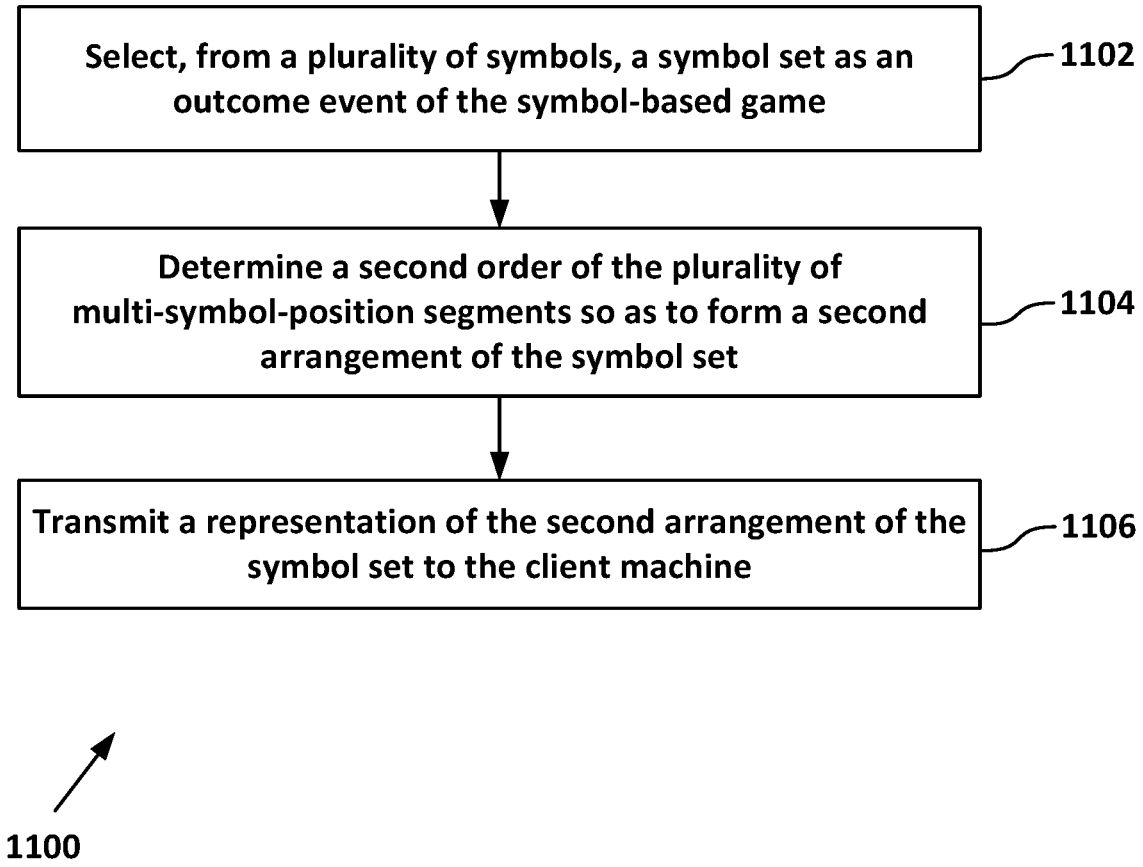
FIG. 11 is a flow chart, in accordance with example embodiments.

FIG. 11 depicts a flowchart showing a set of operations 1100 (or more simply, "the set 1100") that can, for example, be carried out using server machine 100*a* and/or client machine 100*b*. To the extent that a client machine carries out any of the set 1100, these operations may also include displaying various types of information, such as a first arrangement of a symbol set, a second arrangement of the symbol set, a payout amount associated with the first arrangement of the symbol set, and a payout amount associated with the second arrangement of the symbol set. Note that several of the operations described in connection with FIG. 11 parallel operations described in connection with FIGS. 6A and 6B, FIGS. 9A and 9B, and FIGS. 10A and 10B. As such, variations of the operations described in connection with FIGS. 6A and 6B, FIGS. 9A and 9B, and FIGS. 10A and 10B are likewise applicable to the operations described in connection with FIG. 11.

The set of operations 1100 can be carried out to perform symbol rearrangement in a symbol-based game. The symbol-based game can be executed on behalf of a client machine. Further, a memory can store a plurality of symbols for the symbol-based game.

Turning to FIG. 11, block 1102 includes selecting, from a plurality of symbols, a symbol set as an outcome event of the symbol-based game. The symbol set includes multiple symbols. Each symbol of the symbol set can be associated with a respective symbol position within a respective MSPS among a plurality of MSPSs. The MSPSs of the plurality of MSPSs can be arranged in a first order so as to form a first arrangement of the symbol set. The outcome event can be a base outcome event or a bonus outcome event.

Next, block 1104 includes determining a second order of the plurality of MSPSs, without altering which symbols are associated with each respective MSPS, so as to form a second arrangement of the symbol set. The second arrangement of the symbol set is different from the first arrangement of the symbol set.

Next, block 1106 includes transmitting a representation of the second arrangement of the symbol set to the client machine. Reception of the representation of the second arrangement of the symbol set can cause the client machine to display the second arrangement of the symbol set on a display.

In some embodiments, determining the second order of the plurality of MSPSs may involve determining the second order without altering which symbol is associated with each respective symbol position within each respective multi-symbol-position segment.

In some embodiments, determining the second order may involve randomly determining the second order. Randomly determining the second order may involve assigning different respective integers to each of the multi-symbol-position segments, and randomly generating a sequence of the different respective integers without replacement. Additionally or alternatively, randomly determining the second order may involve randomly selecting a multi-symbol-position segment of the plurality of multi-symbol-position segments, and altering a location within the first order of the selected multi-symbol-position segment so as to determine the second order. Additionally or alternatively, randomly determining the second order may involve randomly selecting a first multi-symbol-position segment of the plurality of multi-position-symbol segments and a second multi-symbol-position segment of the plurality of multi-position-symbol segments, and swapping respective locations within the first order of the first multi-symbol-position segment and the second multi-symbol-position segment so as to determine the second order. Additionally or alternatively, randomly determining the second order may involve randomly selecting the second order from a plurality of permutations of the first order.

In some embodiments, determining the second order may involve reversing the first order so as to determine the second order.

In some embodiments, the operations 1100 may also involve encountering a trigger to rearrange the first order (not shown). Further, determining the second order may involve determining the second order in response to encountering the trigger. Encountering the trigger may involve determining that the symbol set includes a trigger symbol. Additionally or alternatively, encountering the trigger may involve determining that the first arrangement of the symbol set includes a winning combination. Encountering the trigger could instead involve determining that the first arrangement of the symbol set does not include a winning combination.

In some embodiments, the plurality of multi-symbol-position segments can form a grid of symbol positions. The plurality of multi-symbol-position segments can include columns of the grid of symbol positions, and determining the second order can involve determining a second order of the columns within the grid of symbol positions. Additionally or alternatively, the plurality of multi-symbol-position segments can include rows of the grid of symbol positions, and determining the second order can involve determining a second order of the rows within the grid of symbol positions.

In some embodiments, the operations 1100 may also involve transmitting a representation of the first arrangement of the symbol set to the client machine. Reception of the representation of the first arrangement of the symbol set can cause the client machine to display the first arrangement of the symbol set on the display. Further, reception of the representation of the second arrangement of the symbol set can cause the client machine to transition from displaying the first arrangement of the symbol set to displaying the second arrangement of the symbol set. In addition, in some embodiments, the first arrangement of the symbol set includes a first winning combination. Further, reception of the representation of the first arrangement of the symbol set causes the client machine to display an indication of the first winning combination. The second arrangement of the symbol set can also include a second winning combination that is different from the first winning combination. Reception of the second arrangement of the symbol set can cause the client machine to display an indication of the second winning combination. Additionally or alternatively, the symbol-based game can be a reel-based game, and reception of the representation of the first arrangement of the symbol set can cause the client machine to display, on the display, a spin of a plurality of reels resulting in the first arrangement of the symbol set on the display.

In some embodiments, the symbol-based game can be a reel-based game. The memory can store respective pluralities of symbols for the reels. The respective pluralities of symbols for the reels can be arranged in respective cyclical sequences of the symbols. Selecting the symbol set can involve, for the reels, randomly selecting respective reel positions such that respective subsequences of the symbols thereon are in the symbol set.

In some embodiments, the first arrangement of the symbol set can include a winning combination. The operations 1100 can then further include determining a payout amount associated with the first arrangement of the symbol set, and transmitting, to the client machine, an indication of the payout amount associated with the first arrangement of the symbol set.

In some embodiments, the second arrangement of the symbol set can include a winning combination. The operations 1100 can then further include determining a payout amount associated with the second arrangement of the symbol set, and transmitting to the client machine, an indication of the payout amount associated with the second arrangement of the symbol set.

Some embodiments may involve simultaneously executing symbol-based games in real time on behalf of at least thirty client machines, where each of the at least thirty client machines communicates with the one or more processors by way of a wide-area, packet-switched network. In some cases, the one or more processors may simultaneously execute symbol-based games in real time on behalf of more or fewer than thirty client machines. For instance, this simultaneous execution may involve ten, twenty, fifty, one hundred, or one thousand client machines, or another extent of client machines.

Particularly, simultaneous execution of such a large number of symbol-based games in real time necessitates computer implementation. When taking part in an online game, such as the symbol-based games disclosed that involve symbol rearrangement, players expect results of wagers or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of symbol-based games in real time would not exist but for computer implementation thereof.

Figure 12:
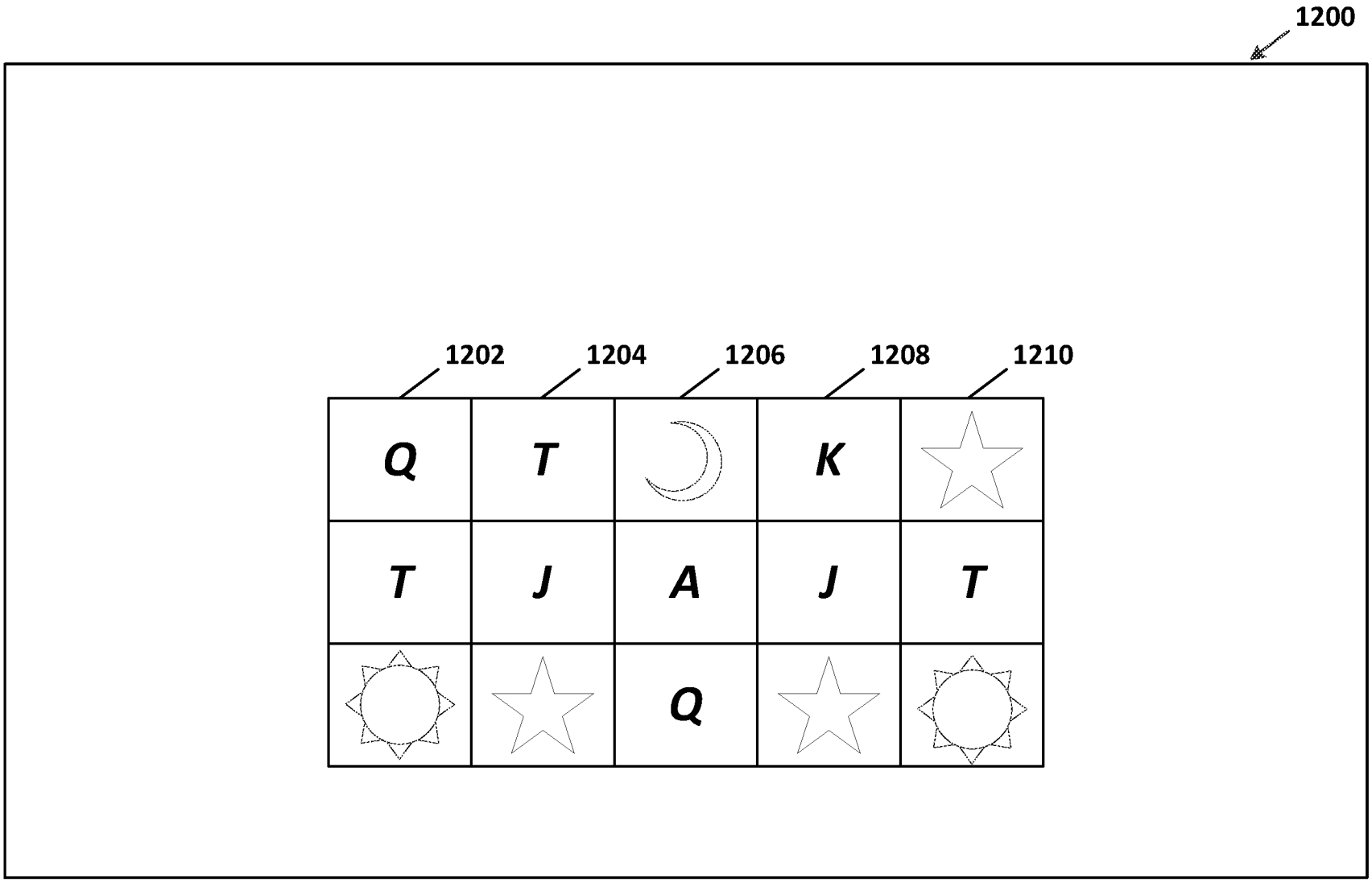
FIG. 12 depicts elements displayable by a display of a machine, in accordance with example embodiments.
Figure 13:
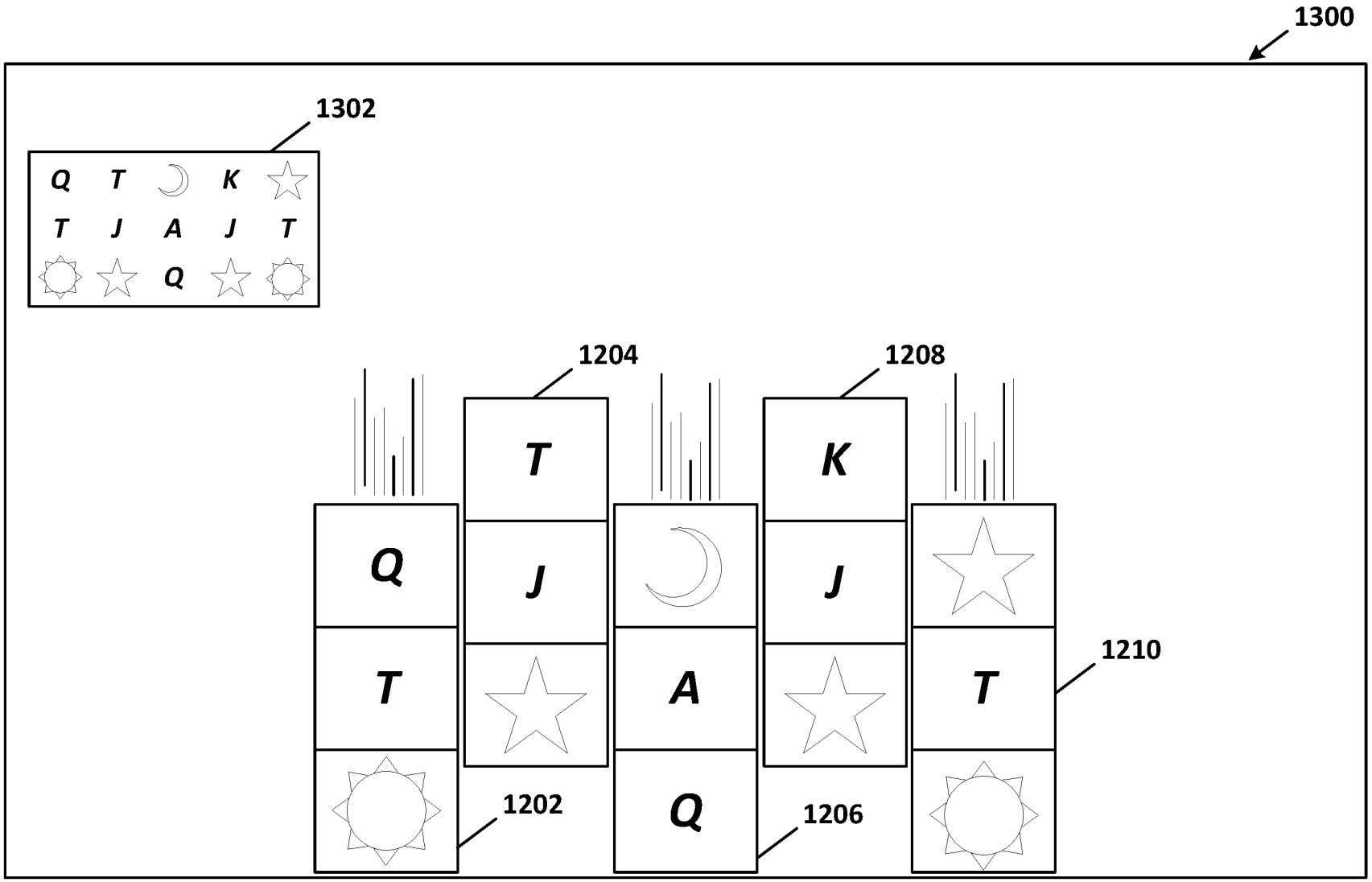
FIG. 13 depicts elements displayable by a display of a machine, in accordance with example embodiments.
Figure 14:
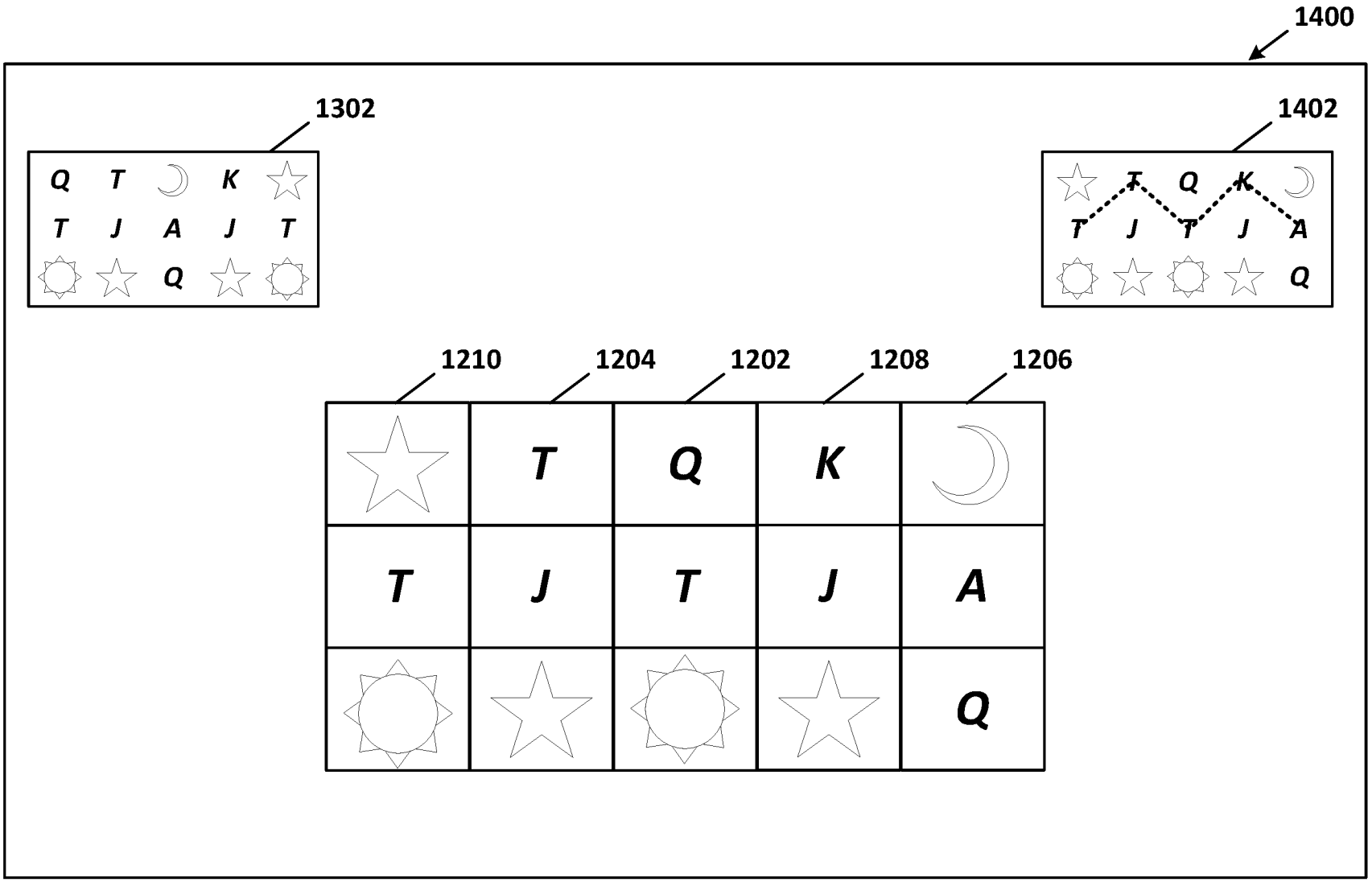
FIG. 14 depicts elements displayable by a display of a machine, in accordance with example embodiments.

FIGS. 12, 13, and 14 provide an example of elements that can be displayed for an outcome event. The elements can be provided on a display, such as display 110*b* of client machine 100*b*.

In FIG. 12, display 1200 depicts a first arrangement of a symbol set. In some examples, display 1200 can depict a spinning of five reels resulting in the first arrangement of the symbol set (not shown).

In FIG. 13, display 1300 depicts a snapshot 1302 of the first arrangement of the symbol set. The snapshot 1302 can highlight any winning combinations in the first arrangement of the symbol set, however there are not any winning combinations in the first arrangement in this example. Display 1300 also depicts part of an animation in which the order of the MSPSs 1202, 1204, 1206, 1208, and 1210 is rearranged without altering which symbols are associated with each respective MSPS. The animation involves MSPSs 1202, 1206, and 1210 dropping down and separating from MSPSs 1204 and 1208 prior to the order of the MSPSs 1202, 1204, 1206, 1208, and 1210 being rearranged.

In some examples, a memory can store a plurality of animation templates. Each animation template may correspond to a particular rearrangement of MSPSs. For instance, a first animation template can correspond to rearranging the order of the MSPSs 1202, 1204, 1206, 1208, and 1210 into an order of MSPS 1210, MSPS 1204, MSPS 1202, MSPS 1208, MSPS 1206. Upon determining a rearranged order of the MSPSs 1202, 1204, 1206, 1208, 1210, a processor, such as a processor of client machine 100*b*, can determine that the rearranged order corresponds to the first animation template, and retrieve the first animation template from the memory. Further, processor can then use the first animation template to cause a display to display an animation in which the order of the MSPSs 1202, 1204, 1206, 1208, and 1210 is arranged. Using the first animation template may involve inserting symbol images into the first animation template.

In FIG. 14, display 1400 depicts a second arrangement of the symbol set. In the second arrangement, the order of the MSPSs 1202, 1204, 1206, 1208, and 1210 has been rearranged as compared to the order of the MSPSs 1202, 1204, 1206, 1208, and 1210 in the first arrangement. Display 1400 also depicts the snapshot 1302 of the first arrangement, and a snapshot 1402 of the second arrangement of the symbol set. The snapshot 1402 highlights a winning combination, three-of-a-kind, in the second arrangement, by illustrating the pay line having the winning combination. The winning combination is not present in the first arrangement of the symbol set.

V. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method of symbol rearrangement in a symbol-based game, wherein the symbol-based game is executed on behalf of a client machine, and wherein a memory stores a plurality of symbols for the symbol-based game, the method comprising:

selecting, by a processor from the plurality of symbols, a symbol set as an outcome event of the symbol-based game, wherein the symbol set includes multiple symbols, wherein each symbol of the symbol set is associated with a respective symbol position within a respective multi-symbol-position segment among a plurality of multi-symbol-position segments, wherein the plurality of multi-symbol position segments includes at least three multi-symbol-position segments, and wherein the multi-symbol-position segments of the plurality of multi-symbol-position segments are arranged in a first order so as to form a first arrangement of the symbol set;

encountering, by the processor, a trigger to rearrange the first order, wherein encountering the trigger comprises determining that the first arrangement of the symbol set does not include a winning combination;

determining, by the processor and in response to encountering the trigger, a second order of the plurality of multi-symbol-position segments by rearranging the multi-symbol-position segments of the plurality of multi-symbol-position segments in a predetermined manner, without altering which symbols are associated with each respective multi-symbol-position segment, so as to form a second arrangement of the symbol set, wherein rearranging the multi-symbol-position segments in the predetermined manner comprises: (i) moving a multi-symbol-position segment in a last position within the first order to a first position within the first order and (ii) incrementing respective positions of each other multi-symbol-position segment of the plurality of multi-symbol-position segments within the first order by one position; and transmitting, by the processor, a representation of the second arrangement of the symbol set to the client machine, wherein reception of the representation of the second arrangement of the symbol set causes the client machine to display the second arrangement of the symbol set on a display.

2. The method of claim 1, wherein determining the second order comprises determining the second order without altering which symbol is associated with each respective symbol position within each respective multi-symbol-position segment.

3. The method of claim 1, wherein encountering the trigger further comprises determining, by the processor, that the symbol set includes a trigger symbol.

4. The method of claim 1, wherein the plurality of multi-symbol-position segments form a grid of symbol positions, wherein the plurality of multi-symbol-position segments comprises columns of the grid of symbol positions, and wherein determining the second order comprises determining a second order of the columns within the grid of symbol positions.

5. The method of claim 1, wherein the plurality of multi-symbol-position segments form a grid of symbol positions, wherein the plurality of multi-symbol-position segments comprises rows of the grid of symbol positions, and wherein determining the second order comprises determining a second order of the rows within the grid of symbol positions.

6. The method of claim 1, further comprising transmitting, by the processor, a representation of the first arrangement of the symbol set to the client machine, wherein reception of the representation of the first arrangement of the symbol set causes the client machine to display the first arrangement of the symbol set on the display, and wherein reception of the representation of the second arrangement of the symbol set causes the client machine to transition from displaying the first arrangement of the symbol set to displaying the second arrangement of the symbol set.

7. The method of claim 6, wherein the symbol-based game is a reel-based game, and wherein reception of the representation of the first arrangement of the symbol set causes the client machine to display, on the display, a spin of a plurality of reels resulting in the first arrangement of the symbol set on the display.

8. The method of claim 1, wherein the symbol-based game is a reel-based game, and wherein the memory stores respective pluralities of symbols for reels of the reel-based game, wherein the respective pluralities of symbols for the reels are arranged in respective cyclical sequences of symbols, and wherein selecting the symbol set comprises:

for the reels, randomly selecting respective reel positions such that respective subsequences of the symbols thereon are in the symbol set.

9. A gaming machine comprising:

a processor;

memory; and program instructions, stored in the memory, that upon execution by the processor cause the gaming machine to perform operations comprising:

selecting, from a plurality of symbols of a symbol-based game, a symbol set as an outcome event of the symbol-based game, wherein the symbol set includes multiple symbols, wherein each symbol of the symbol set is associated with a respective symbol position within a respective multi-symbol-position segment among a plurality of multi-symbol-position segments, wherein the plurality of multi-symbol position segments includes at least three multi-symbol-position segments, and wherein the multi-symbol-position segments of the plurality of multi-symbol-position segments are arranged in a first order so as to form a first arrangement of the symbol set;

encountering a trigger to rearrange the first order, wherein encountering the trigger comprises determining that the first arrangement of the symbol set does not include a winning combination;

in response to encountering the trigger, determining a second order of the plurality of multi-symbol-position segments by rearranging the multi-symbol-position segments of the plurality of multi-symbol-position segments in a predetermined manner, without altering which symbols are associated with each respective multi-symbol-position segment, so as to form a second arrangement of the symbol set, wherein rearranging the multi-symbol-position segments in the predetermined manner comprises: (i) moving a multi-symbol-position segment in a last position within the first order to a first position within the first order and (ii) incrementing respective positions of each other multi-symbol-position segment of the plurality of multi-symbol-position segments within the first order by one position; and transmitting a representation of the second arrangement of the symbol set to a client machine, wherein reception of the representation of the second arrangement of the symbol set causes the client machine to display the second arrangement of the symbol set on a display.

10. The gaming machine of claim 9, wherein determining the second order comprises determining the second order without altering which symbol is associated with each respective symbol position within each respective multi-symbol-position segment.

11. A gaming system configured for symbol rearrangement in a symbol-based game, wherein the symbol-based game is executed on behalf of a client machine, wherein the symbol-based game involves determining sets of symbols to generate outcome events, the gaming system comprising:

a plurality of client machines each including at least one display device and a plurality of input devices including (i) an acceptor of a physical item associated with a monetary value, (ii) a validator configured to identify the physical item, and (iii) a cash-out button actuatable to cause an initiation of a payout associated with a credit account;

one or more client machine processors; and one or more client machine memory devices storing a plurality of client machine instructions, the plurality of client machine instructions executable by the one or more client machine processors to perform operations comprising:

selecting, from a plurality of symbols of a symbol-based game, a symbol set as an outcome event of the symbol-based game, wherein the symbol set includes multiple symbols, wherein each symbol of the symbol set is associated with a respective symbol position within a respective multi-symbol-position segment among a plurality of multi-symbol-position segments, wherein the plurality of multi-symbol position segments includes at least three multi-symbol-position segments, and wherein the multi-symbol-position segments of the plurality of multi-symbol-position segments are arranged in a first order so as to form a first arrangement of the symbol set;

encountering a trigger to rearrange the first order, wherein encountering the trigger comprises determining that the first arrangement of the symbol set does not include a winning combination;

in response to encountering the trigger, determining a second order of the plurality of multi-symbol-position segments by rearranging the multi-symbol-position segments of the plurality of multi-symbol-position segments in a predetermined manner, without altering which symbols are associated with each respective multi-symbol-position segment, so as to form a second arrangement of the symbol set, wherein rearranging the multi-symbol-position segments in the predetermined manner comprises: (i) moving a multi-symbol-position segment in a last position within the first order to a first position within the first order and (ii) incrementing respective positions of each other multi-symbol-position segment of the plurality of multi-symbol-position segments within the first order by one position; and transmitting a representation of the second arrangement of the symbol set to a client machine, wherein reception of the representation of the second arrangement of the symbol set causes the client machine to display the second arrangement of the symbol set on a display.

* * * * *